US011204560B2

(12) United States Patent
Tokimitsu et al.

(10) Patent No.: US 11,204,560 B2
(45) Date of Patent: Dec. 21, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Ryoichi Tokimitsu, Kashiwa (JP); Koichi Nakata, Tokyo (JP); Haruki Mori, Nagareyama (JP); Shubun Kujirai, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/855,035

(22) Filed: Apr. 22, 2020

(65) Prior Publication Data

US 2020/0341391 A1 Oct. 29, 2020

(30) Foreign Application Priority Data

Apr. 26, 2019 (JP) ..... JP2019-086292

(51) Int. Cl.

| | |
|---|---|
| ***G03G 5/05*** | (2006.01) |
| ***G03G 5/047*** | (2006.01) |
| ***G03G 21/18*** | (2006.01) |
| ***G03G 5/07*** | (2006.01) |

(52) U.S. Cl.

CPC ..... *G03G 5/047* (2013.01); *G03G 5/0517* (2013.01); *G03G 5/0589* (2013.01); *G03G 5/0592* (2013.01); *G03G 5/071* (2013.01); *G03G 21/18* (2013.01)

(58) Field of Classification Search

CPC ..... G03G 5/147; G03G 5/14708; G03G 5/14713; G03G 5/14717; G03G 5/14726; G03G 5/14786

See application file for complete search history.

(56) References Cited

U.S. PATENT DOCUMENTS

| | | | | |
|---|---|---|---|---|
| 5,374,494 | A * | 12/1994 | Kashimura | G03G 5/0592 358/296 |
| 7,186,489 | B2 | 3/2007 | Uematsu et al. | |
| 7,226,711 | B2 | 6/2007 | Amamiya et al. | |
| 7,534,534 | B2 | 5/2009 | Nakata et al. | |
| 8,673,526 | B2 * | 3/2014 | Sonobe | G03G 5/0614 430/66 |
| 9,316,931 | B2 | 4/2016 | Takagi et al. | |
| 9,389,523 | B2 | 6/2016 | Nakata et al. | |

(Continued)

FOREIGN PATENT DOCUMENTS

| | | | | |
|---|---|---|---|---|
| JP | 2000-066425 | | 3/2000 | |
| JP | 2000-206724 | * | 7/2000 | G03G 5/147 |

(Continued)

OTHER PUBLICATIONS

Translation of JP 2000-206724.*

(Continued)

*Primary Examiner* — Peter L Vajda

(74) *Attorney, Agent, or Firm* — Venable LLP

(57) ABSTRACT

Provided is an electrophotographic photosensitive member including a support and a surface layer, wherein the surface layer contains a copolymer of a composition containing a specific hole transporting compound and a specific compound.

5 Claims, 2 Drawing Sheets

(56) References Cited

U.S. PATENT DOCUMENTS

| | | | |
|---|---|---|---|
| 9,594,318 | B2 | 3/2017 | Nakata et al. |
| 9,740,117 | B2 | 8/2017 | Kosaka et al. |
| 9,811,012 | B2 | 11/2017 | Murakami et al. |
| 9,983,490 | B2 | 5/2018 | Shimada et al. |
| 10,042,272 | B2 | 8/2018 | Mori et al. |
| 10,310,395 | B2 | 6/2019 | Nakata et al. |
| 10,365,569 | B2 | 7/2019 | Tokimitsu et al. |
| 10,451,984 | B2 | 10/2019 | Mori et al. |
| 10,488,769 | B2 | 11/2019 | Nakata et al. |
| 10,488,771 | B2 | 11/2019 | Mori et al. |
| 10,558,132 | B2 | 2/2020 | Ishiduka et al. |
| 10,558,133 | B2 | 2/2020 | Nakamura et al. |
| 2014/0004450 | A1 | 1/2014 | Tokimitsu et al. |
| 2018/0335708 | A1 | 11/2018 | Nakata et al. |
| 2019/0361365 | A1 | 11/2019 | Mori et al. |
| 2019/0369514 | A1 | 12/2019 | Watanabe et al. |
| 2019/0391504 | A1* | 12/2019 | Nakata ..... G03G 5/0596 |
| 2020/0159136 | A1 | 5/2020 | Mori et al. |
| 2020/0201200 | A1 | 6/2020 | Tokimitsu et al. |
| 2020/0218171 | A1 | 7/2020 | Takeuchi et al. |

FOREIGN PATENT DOCUMENTS

| | | |
|---|---|---|
| JP | 2007-147986 | 6/2007 |
| JP | 6024279 | 9/2012 |
| JP | 6046678 | 10/2012 |

OTHER PUBLICATIONS

U.S. Appl. No. 16/777,173, Koichi Nakata, filed Jan. 30, 2020.
U.S. Appl. No. 16/855,022, Kenichi Ikari, filed Apr. 22, 2020.
U.S. Appl. No. 16/894,977, Shubun Kujirai, filed Jun. 8, 2020.
U.S. Appl. No. 16/894,988, Eileen Takeuchi, filed Jun. 8, 2020.
U.S. Appl. No. 16/936,508, Takahiro Mitsui, filed Jul. 23, 2020.
U.S. Appl. No. 16/936,642, Mai Kaku, filed Jul. 23, 2020.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a process cartridge having the electrophotographic photosensitive member, and an electrophotographic apparatus including the electrophotographic photosensitive member.

Description of the Related Art

As an electrophotographic photosensitive member to be mounted on an electrophotographic apparatus, there is known an organic electrophotographic photosensitive member containing an organic photoconductive substance (charge generating substance), which has hitherto been extensively studied. Hereinafter, unless otherwise specified, the term "electrophotographic photosensitive member" that is simply referred refers to an organic electrophotographic photosensitive member.

In recent years, in order to extend the lifetime of the electrophotographic photosensitive member and to enhance an image quality, it has been required to improve mechanical durability (abrasion resistance) of the electrophotographic photosensitive member and to reduce variations in electrical characteristics caused by long-term use.

Japanese Patent Application Laid-Open No. 2000-066425 discloses a method for improving mechanical durability of an electrophotographic photosensitive member and stabilizing electrical characteristics of the electrophotographic photosensitive member, by allowing a surface layer of the electrophotographic photosensitive member to contain a polymer obtained by polymerizing a charge transporting substance having a polymerizable functional group.

According to the study of the present inventors, in the electrophotographic photosensitive member disclosed in Japanese Patent Application Laid-Open No. 2000-066425, variations in electrical characteristics in a temperature and humidity environment are large, and a stable image cannot be sufficiently obtained.

Accordingly, an object of the present invention is to provide an electrophotographic photosensitive member that has high mechanical durability and small variations in electrical characteristics in a temperature and humidity environment, and can thus obtain a stable image. In addition, another object of the present invention is to provide a process cartridge having the electrophotographic photosensitive member, and an electrophotographic apparatus including the electrophotographic photosensitive member.

SUMMARY OF THE INVENTION

The above objects are achieved by the following present invention. That is, an electrophotographic photosensitive member according to an aspect of the present invention is an electrophotographic photosensitive member including a support and a surface layer, wherein the surface layer contains a copolymer of a composition containing a hole transporting compound represented by the following Formula (1) and a compound represented by the following Formula (3).

(1)

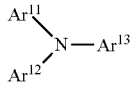

In Formula (1), $Ar^{11}$ to $Ar^{13}$ each independently represent a substituted or unsubstituted phenyl group. At least one of the phenyl groups represented by $Ar^{11}$ to $Ar^{13}$ has a group represented by the following Formula (2) as a substituent. The substituent which may be included in the phenyl group is an alkyl group, an alkoxy group, or the group represented by the following Formula (2).

(2)

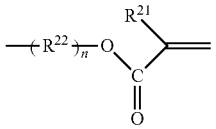

In Formula (2), $R^{21}$ represents a hydrogen atom or a methyl group, and $R^{22}$ represents an alkylene group having 1 or more and 6 or less carbon atoms. n represents 0 or 1.

(3)

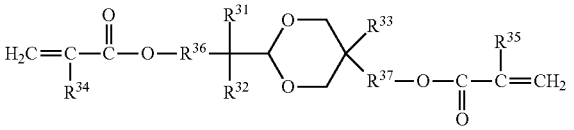

In Formula (3), $R^{31}$ and $R^{32}$ each independently represent an alkyl group having 1 or more and 4 or less carbon atoms or a substituted or unsubstituted aryl group. A substituent which may be included in the aryl group is an alkyl group having 4 or less carbon atoms. $R^{31}$ and $R^{32}$ may be bonded to each other to form a ring. $R^{33}$ represents an alkyl group having 1 or more and 4 or less carbon atoms. $R^{34}$ and $R^{35}$ each independently represent a hydrogen atom or a methyl group. $R^{36}$ and $R^{37}$ each independently represent an alkylene group having 1 or more and 4 or less carbon atoms.

A process cartridge according to another aspect of the present invention integrally supports the electrophotographic photosensitive member and at least one unit selected from the group consisting of a charging unit, a developing unit, a transfer unit, and a cleaning unit, and is detachably attachable to a main body of an electrophotographic apparatus.

An electrophotographic apparatus according to still another aspect of the present invention includes the electrophotographic photosensitive member, a charging unit, an exposing unit, a developing unit, and a transfer unit.

Further features of the present invention will become apparent from the following description of exemplary embodiments with reference to the attached drawings.

DESCRIPTION OF THE EMBODIMENTS

Figure 1:
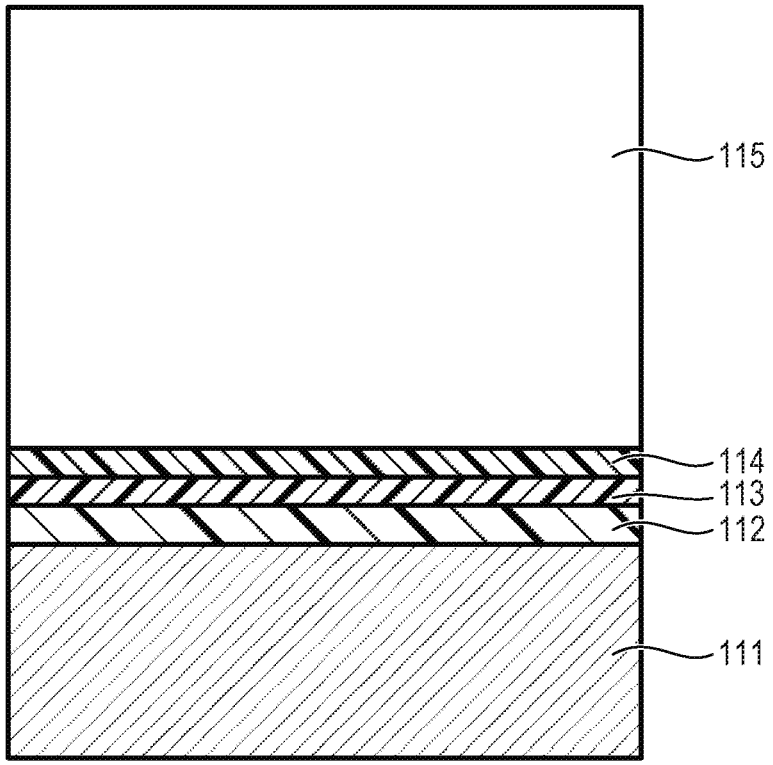
FIG. 1 is a view illustrating an example of a layer configuration of an electrophotographic photosensitive member according to an aspect of the present invention.

Hereinafter, the present invention is described in more detail with reference to the preferred embodiments.

An electrophotographic photosensitive member according to an aspect of the present invention is an electrophotographic photosensitive member including a support and a surface layer, wherein the surface layer contains a copolymer of a composition containing a hole transporting compound represented by the following Formula (1) and a compound represented by the following Formula (3).

(1)

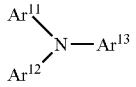

In Formula (1), $Ar^{11}$ to $Ar^{13}$ each independently represent a substituted or unsubstituted phenyl group. At least one of the phenyl groups represented by $Ar^{11}$ to $Ar^{13}$ has a group represented by the following Formula (2) as a substituent. The substituent which may be included in the phenyl group is an alkyl group, an alkoxy group, or the group represented by the following Formula (2).

(2)

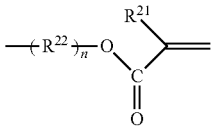

In Formula (2), $R^{21}$ represents a hydrogen atom or a methyl group, and $R^{22}$ represents an alkylene group having 1 or more and 6 or less carbon atoms. n represents 0 or 1.

(3)

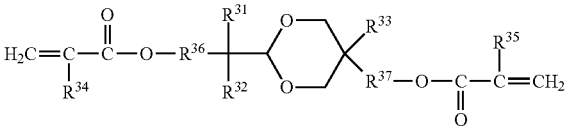

In Formula (3), $R^{31}$ and $R^{32}$ each independently represent an alkyl group having 1 or more and 4 or less carbon atoms or a substituted or unsubstituted aryl group. A substituent which may be included in the aryl group is an alkyl group having 4 or less carbon atoms. $R^{31}$ and $R^{32}$ may be bonded to each other to form a ring. $R^{33}$ represents an alkyl group having 1 or more and 4 or less carbon atoms. $R^{34}$ and $R^{35}$ each independently represent a hydrogen atom or a methyl group. $R^{36}$ and $R^{37}$ each independently represent an alkylene group having 1 or more and 4 or less carbon atoms.

The reason why the electrophotographic photosensitive member according to an aspect of the present invention has electrical characteristics that are not easily affected by a temperature and humidity environment is presumed by the present inventors as follows.

In the case of a charge transporting substance having a triphenylamine structure among charge transporting substances having a polymerizable functional group, due to excellent charge transporting property thereof, a chemical change such as cleavage of a molecular chain or oxidation caused by image formation over a long period of time hardly occurs. Accordingly, image defects caused by long-term use hardly occur.

On the other hand, for a substance having the charge transporting property, the triphenylamine structure is small. Therefore, in a case where a polymer having a triphenylamine structure having a polymerizable functional group is used for the surface layer of the electrophotographic photosensitive member, a large depletion easily occurs on a film of the surface layer, and thus moisture easily permeates into the electrophotographic photosensitive member due to the depletion of the formed surface layer.

In the present invention, the surface layer contains the polymer of the composition containing the compound represented by Formula (3) in addition to the compound represented by Formula (1) having a triphenylamine structure. The compound represented by Formula (3) has an adequately small molecular weight, and has a cyclic structure having polarity. On the other hand, the compound represented by Formula (1) also has a nitrogen atom having polarity, and further has a benzene ring having a cyclic structure. Therefore, the compound represented by Formula (3) has excellent compatibility with the compound represented by Formula (1). That is, the copolymer of the compound represented by Formula (1) and the compound represented by Formula (3) can increase denseness of the surface layer as compared to a polymer of only the compound represented by Formula (1). Accordingly, the permeation of moisture into the electrophotographic photosensitive member is suppressed, and the influence of moisture on the electrophotographic photosensitive member is thus reduced. From the fact described above, it is considered that the influence of the temperature and humidity environment on the electrical characteristics of the electrophotographic photosensitive member is suppressed.

Hereinafter, specific examples of the compound represented by Formula (1) and the compound represented by Formula (3) are described, but the present invention is not limited thereto.

Specific Examples of Compound Represented by Formula (1)

(1-1)

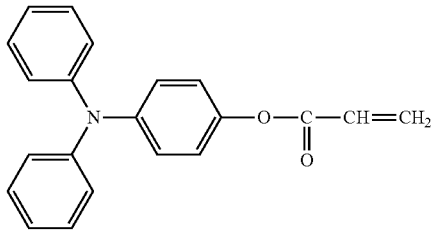

-continued
(1-2)
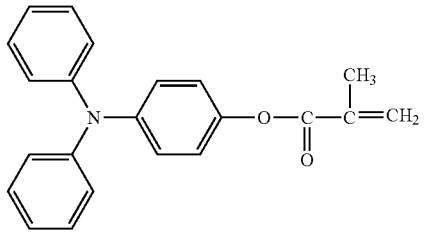
(1-3)
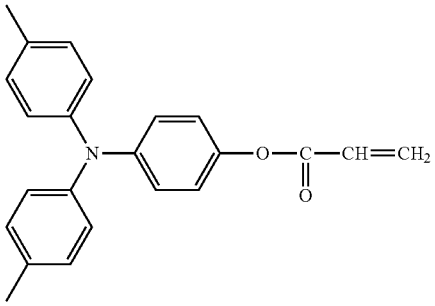
(1-4)
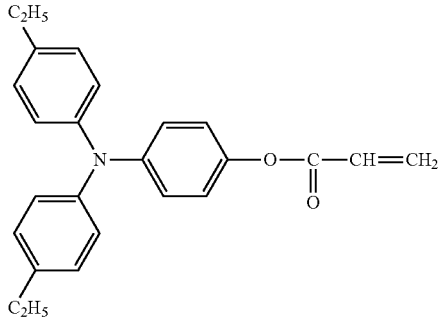
(1-5)
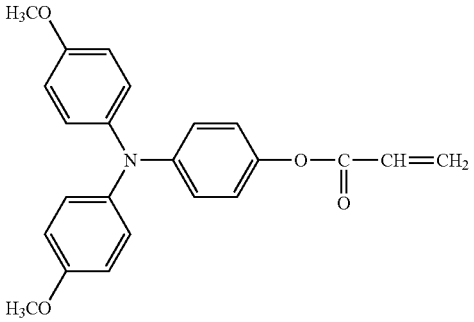
(1-6)
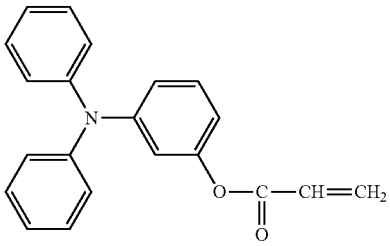
-continued
(1-7)
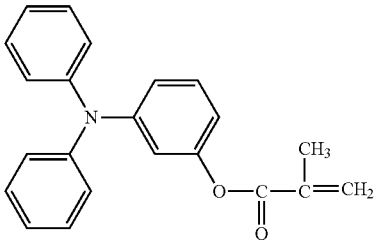
(1-8)
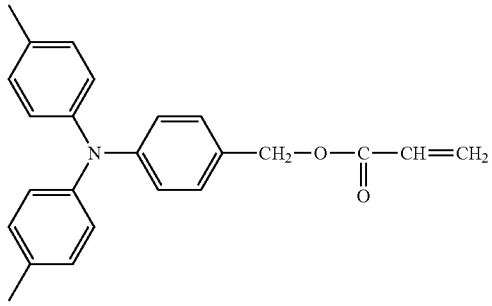
(1-9)
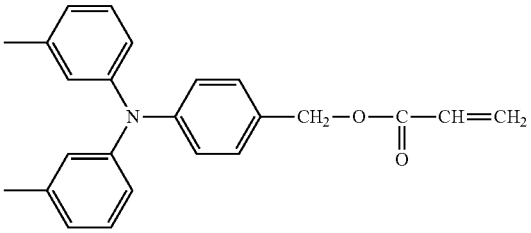
(1-10)
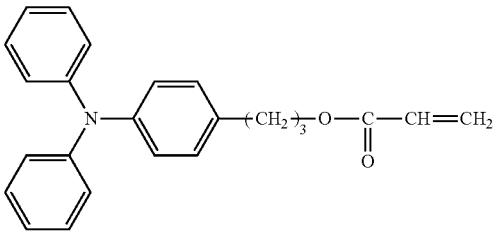
(1-11)
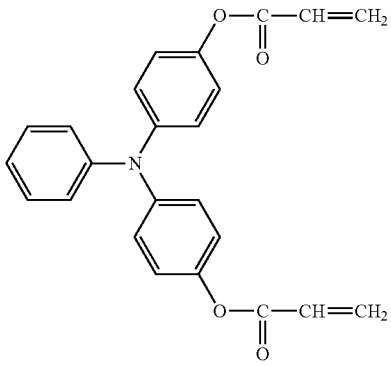

-continued
(1-12)
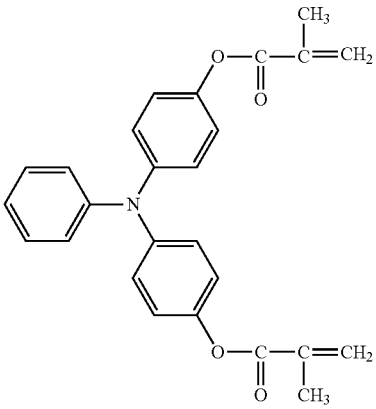
(1-13)
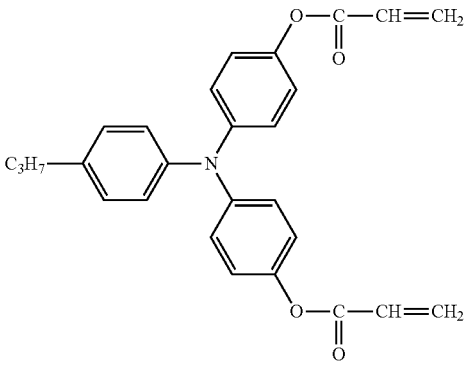
(1-14)
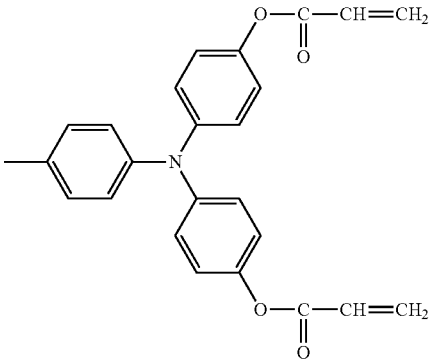
(1-15)
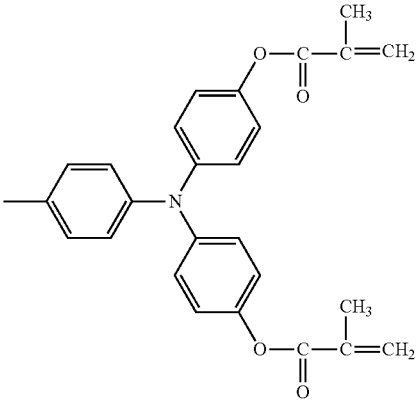
-continued
(1-16)
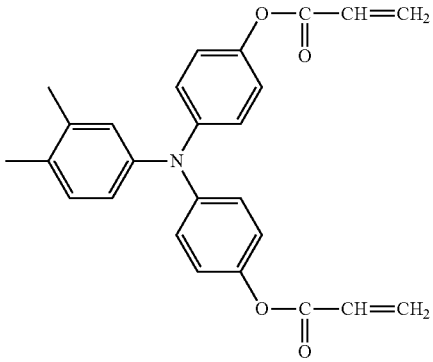
(1-17)
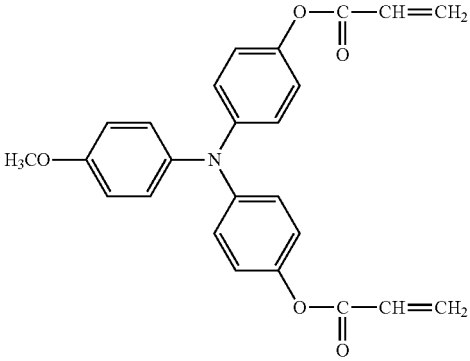
(1-18)
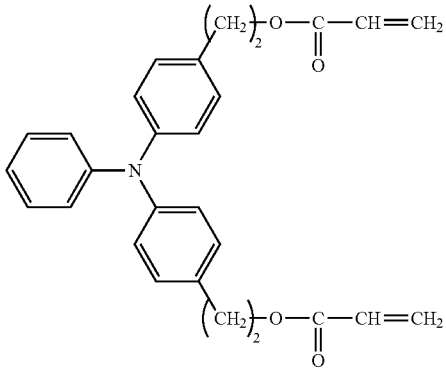
(1-19)
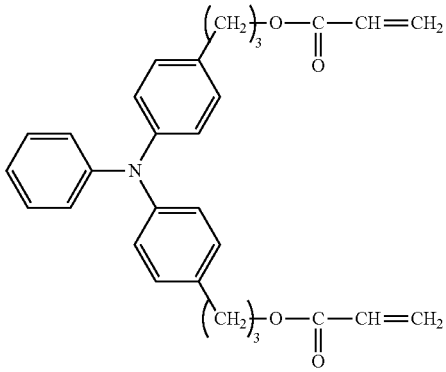

-continued
(1-20)
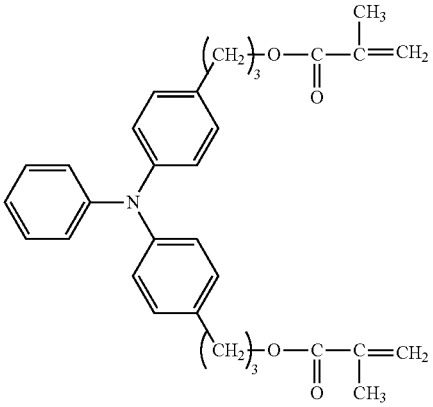
(1-21)
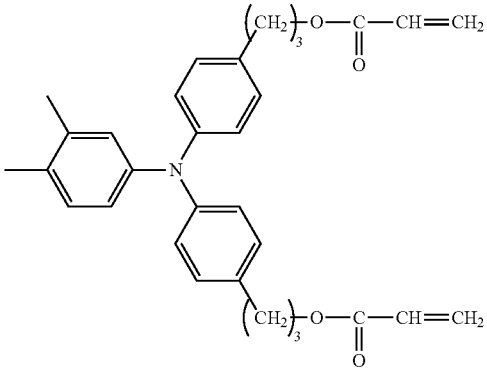
(1-22)
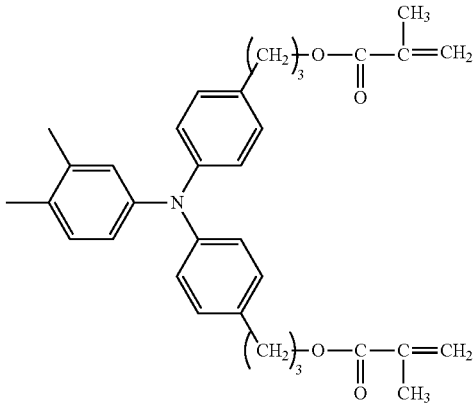
(1-23)
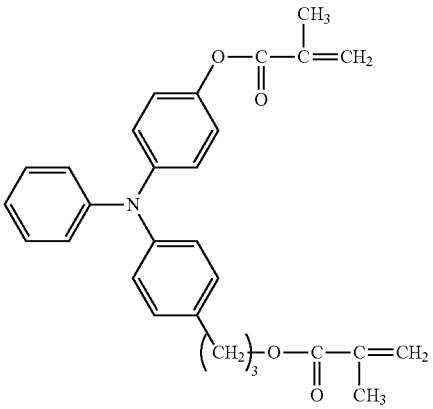
-continued
(1-24)
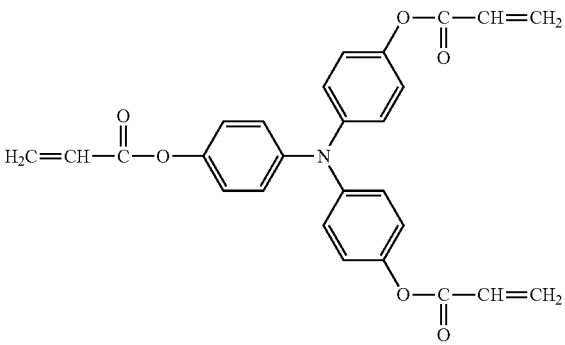
(1-25)
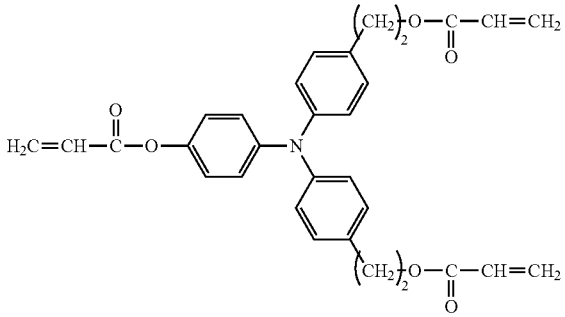
(1-26)
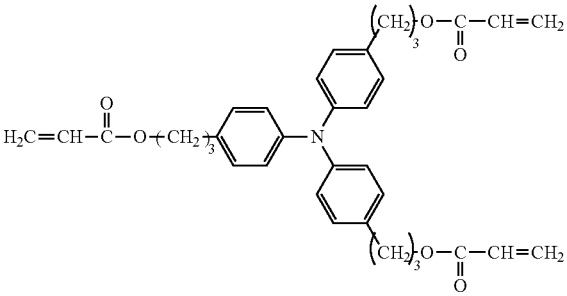
Specific Examples of Compound Represented by Formula (3)
(3-1)
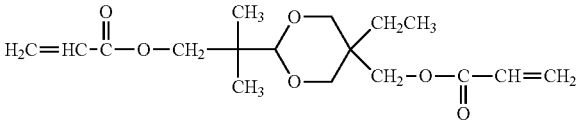
(3-2)
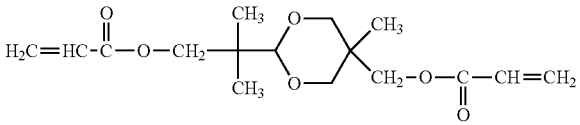

-continued
(3-3)
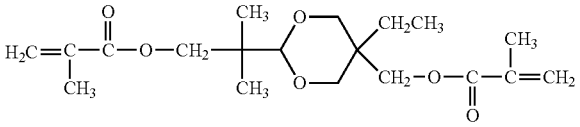
(3-4)
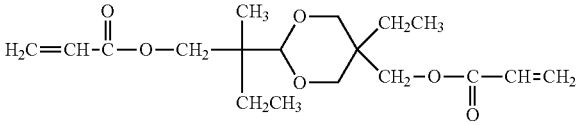
(3-5)
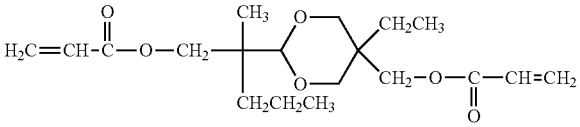
(3-6)
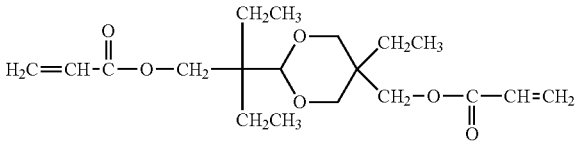
(3-7)
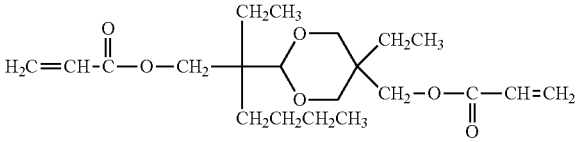
(3-8)
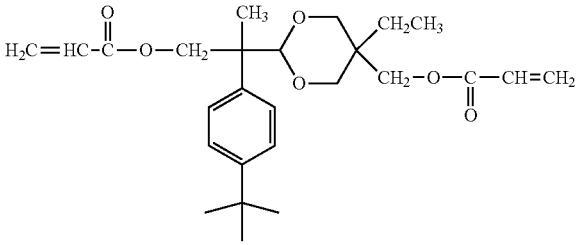
(3-9)
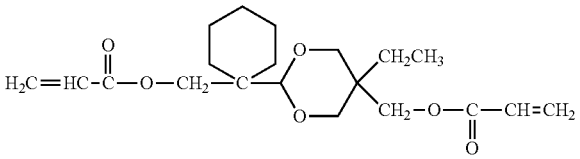
(3-10)
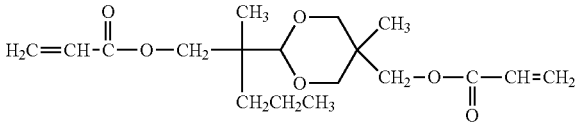
(3-11)
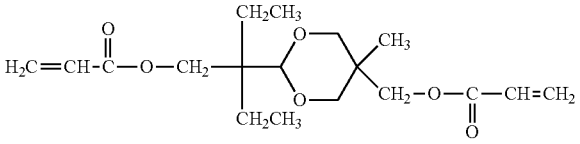
-continued
(3-12)
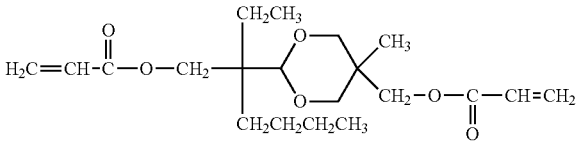
(3-13)
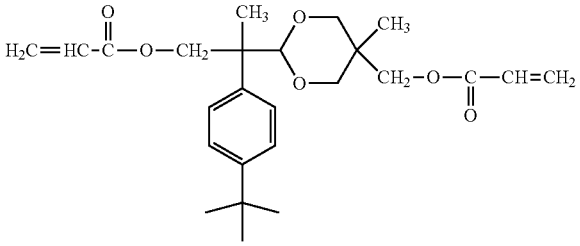
(3-14)
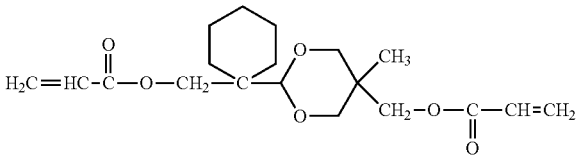
(3-15)
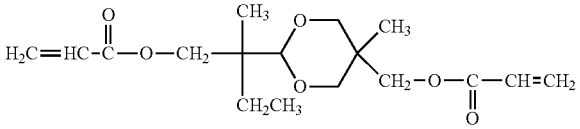
(3-16)
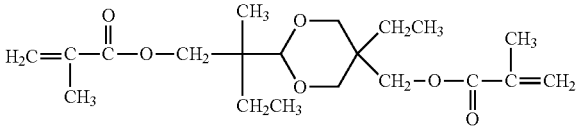
(3-17)
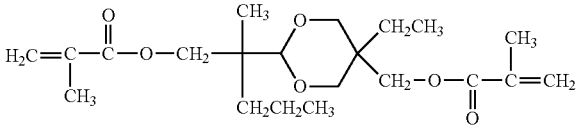
(3-18)
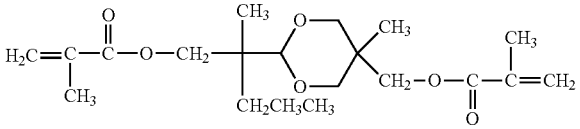
(3-19)
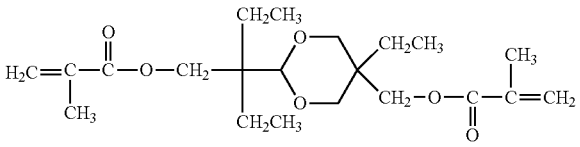

-continued (3-20)

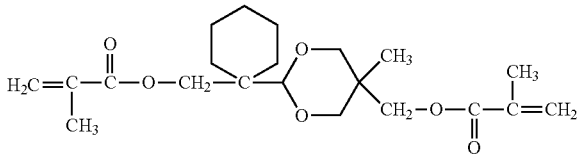

(3-21)

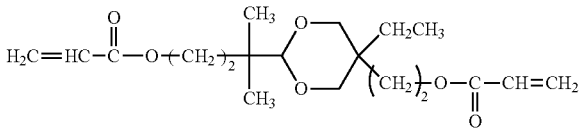

(3-22)

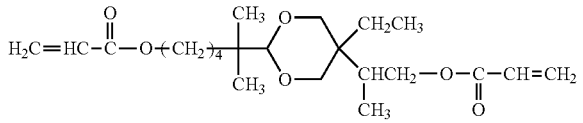

In the compound represented by Formula (3), $R^{36}$ and $R^{37}$ are preferably a methylene group or an ethylene group, from the viewpoint of denseness and a strength of the film. In addition, $R^{31}$ and $R^{32}$ in the compound represented by Formula (3) are preferably a methyl group, from the viewpoint of reducing environmental dependence of the electrical characteristics. When a substituent is a methyl group having a small structure, intermolecular steric repulsion in the film is reduced to increase the denseness of the film. Accordingly, the permeation of moisture into the electrophotographic photosensitive member is suppressed, and the variations in electrical characteristics of the electrophotographic photosensitive member caused by a change in temperature and humidity environment are suppressed.

In the composition, a content of the compound represented by Formula (1) is preferably 30.0 mass % or more with respect to a total amount of the compounds in the surface layer.

In the composition, a content of the compound represented by Formula (3) is preferably 2.0 mass % or more and 70.0 mass % or less with respect to the total amount of the compounds in the surface layer.

In the composition, the content of the compound represented by Formula (3) is preferably greater by 0.1 times or more and 1.0 times or less than that of the hole transporting compound represented by Formula (1) on a mass basis. In the case of 0.1 times or more, the effect of the present invention can be sufficiently increased. In the case of 1.0 times or less, the amount of the hole transporting compound represented by Formula (1) is sufficiently large, and thus the electrophotographic photosensitive member can have excellent electrical characteristics.

In addition, it is preferable that the composition contains a compound represented by the following Formula (4), from the viewpoint of reducing the environmental dependence of the electrical characteristics of the electrophotographic photosensitive member. The present inventors presume the reason as follows. The compound represented by Formula (4) has a structure similar to that of the compound represented by Formula (1), and is easily compatible with the compound represented by Formula (1). In addition, since the compound represented by Formula (4) has an alkylene group and an oxygen atom, the compound represented by Formula (4) is also easily compatible with the compound represented by Formula (3). Therefore, the compound represented by Formula (1) and the compound represented by Formula (3) are easily copolymerized with each other via the compound represented by Formula (4). Accordingly, it is considered that the compound represented by Formula (3) is easily and uniformly distributed in the surface layer, and the denseness of the surface layer is thus increased.

(4)

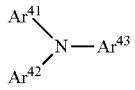

In Formula (4), $Ar^{41}$ to $Ar^{43}$ each independently represent a substituted or unsubstituted phenyl group. At least one of the phenyl groups represented by $Ar^{41}$ to $Ar^{43}$ has a group represented by the following Formula (5). A substituent which may be included in the phenyl group is an alkyl group, an alkoxy group, the group represented by Formula (2), or the group represented by the following Formula (5).

(5)

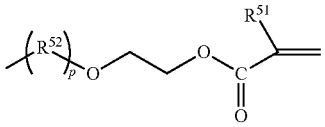

In Formula (5), $R^{51}$ represents a hydrogen atom or a methyl group, and $R^{52}$ represents an alkylene group having 1 or more and 6 or less carbon atoms. p represents 0 or 1.

Hereinafter, specific examples of the compound represented by Formula (4) are described, but the present invention is not limited thereto.

(4-1)

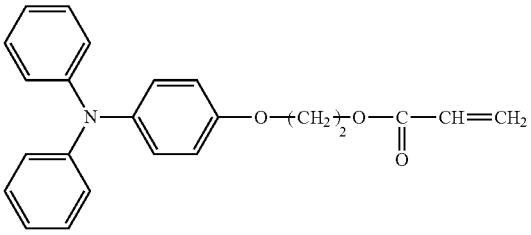

(4-2)

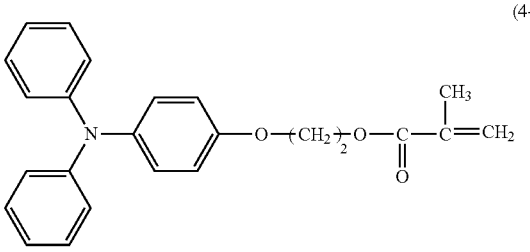

-continued
(4-3)
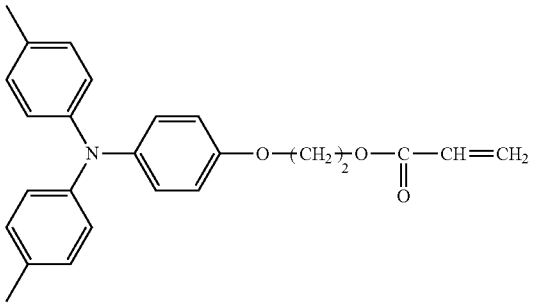
(4-4)
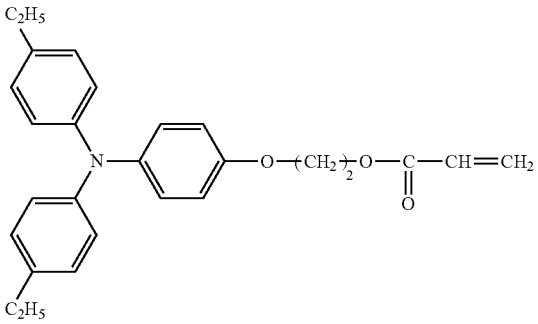
(4-5)
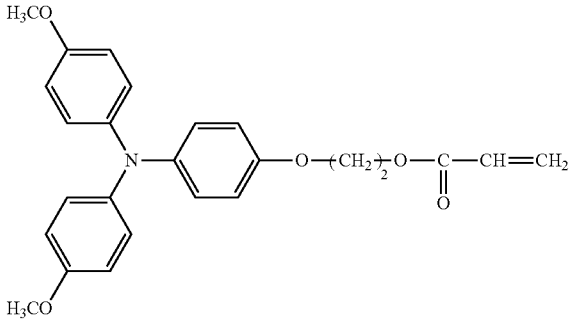
(4-6)
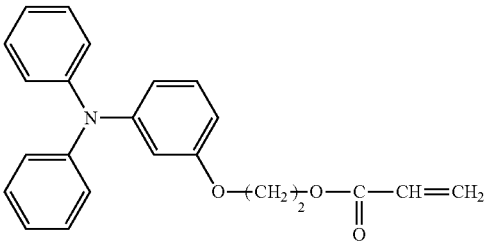
(4-7)
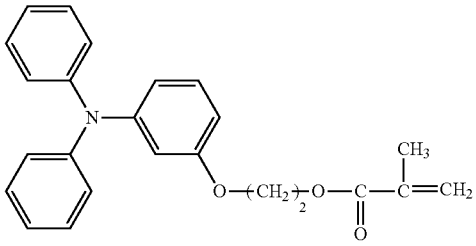
-continued
(4-8)
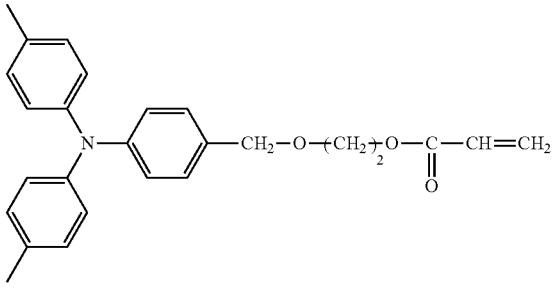
(4-9)
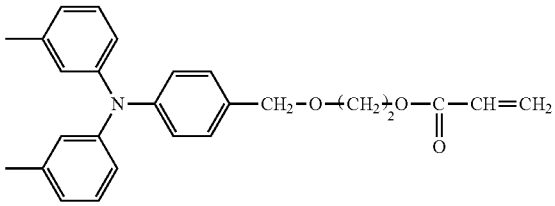
(4-10)
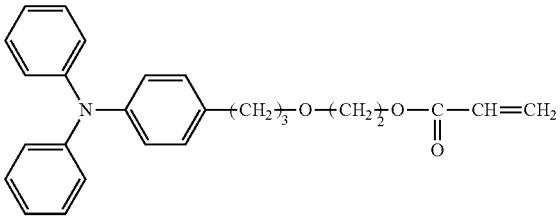
(4-11)
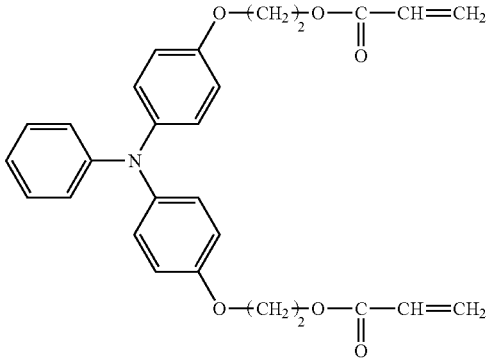
(4-12)
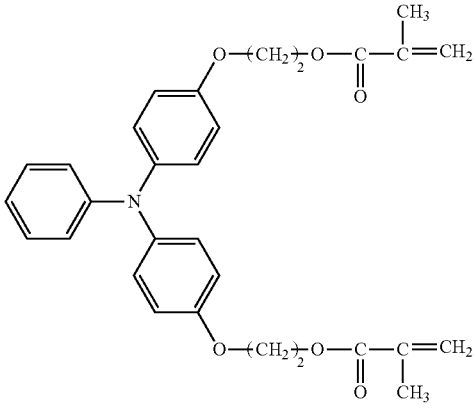

-continued
(4-13)
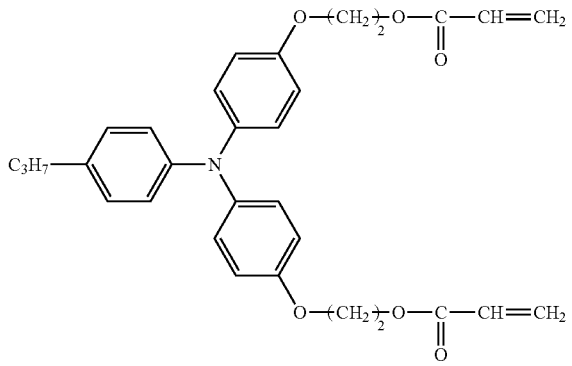
(4-14)
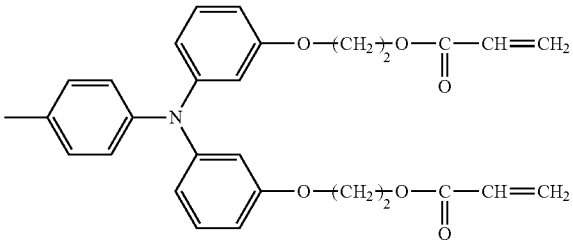
(4-15)
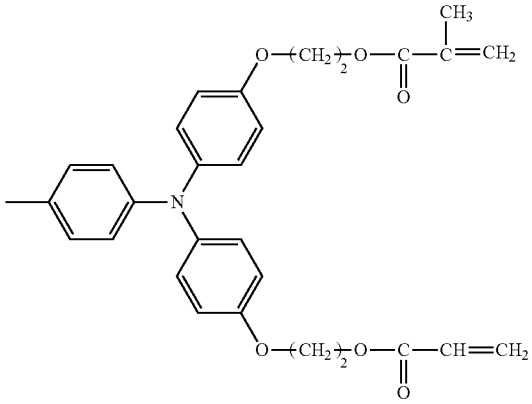
(4-16)
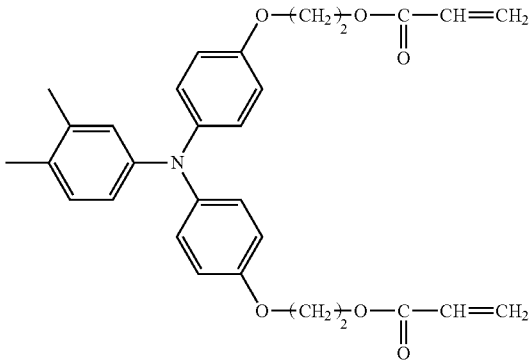
-continued
(4-17)
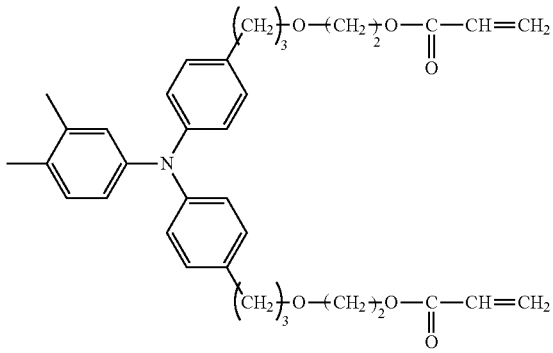
(4-18)
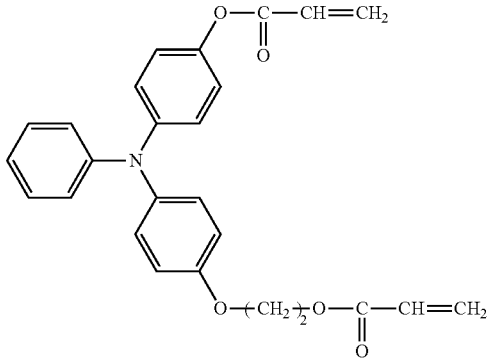
(4-19)
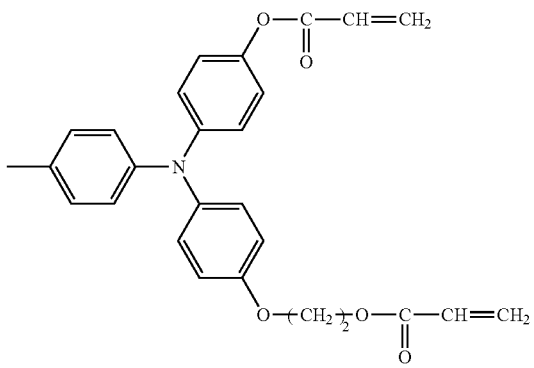
(4-20)
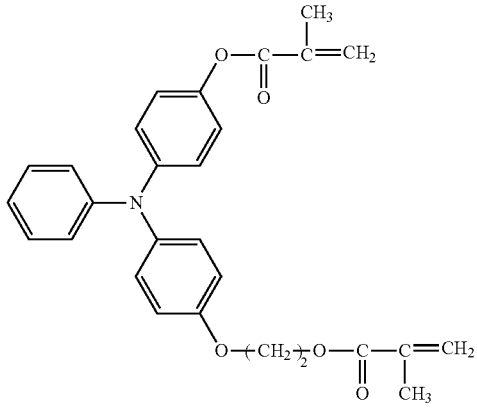

-continued (4-21)

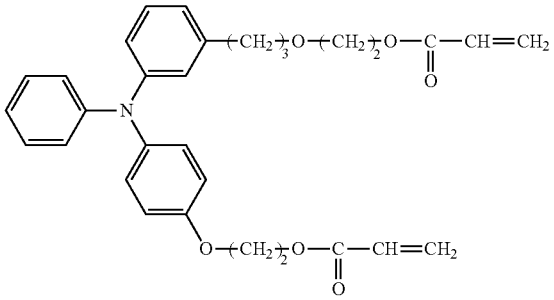

(4-22)

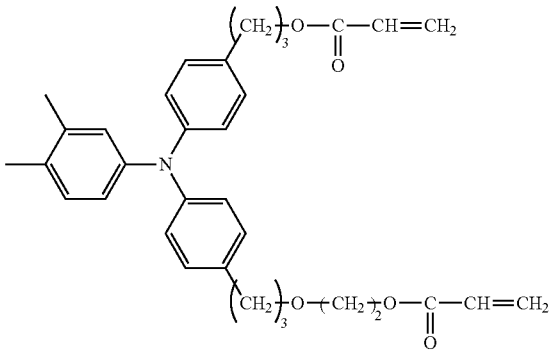

(4-23)

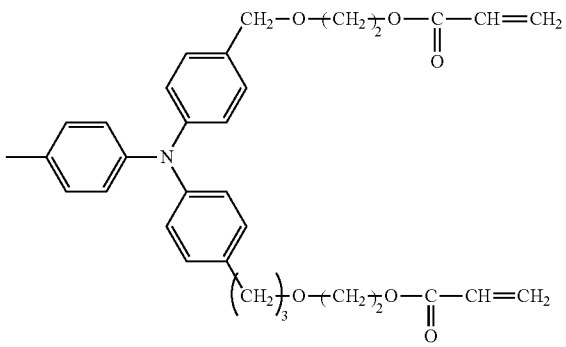

(4-24)

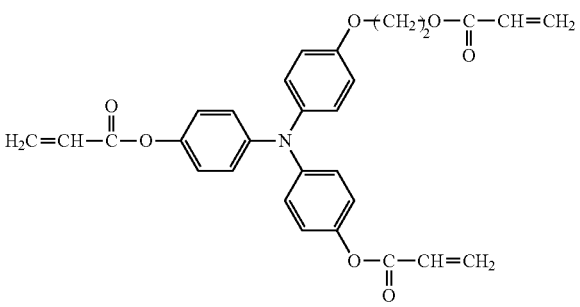

-continued (4-25)

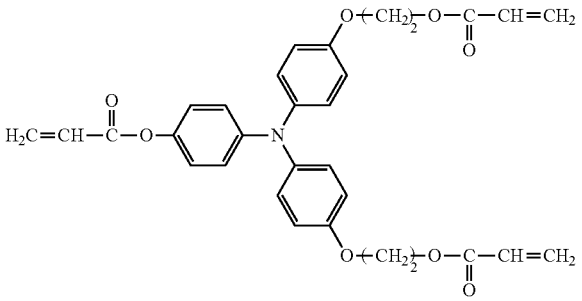

(4-26)

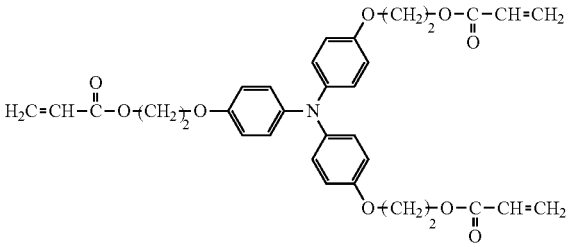

In the composition, a content of the compound represented by Formula (4) is preferably 0.1 mass % or more and 2.0 mass % or less with respect to the total amount of the compounds in the surface layer.

In addition, it is preferable that the composition contains a compound represented by the following Formula (6) or a compound represented by the following Formula (7) from the viewpoint of reducing the environmental dependence of the electrical characteristics. The present inventors presume the reason as follows. The compound represented by Formula (6) and the compound represented by Formula (7) each have a polar moiety at a central portion of a structure. Similarly, since the compound represented by Formula (3) also has a polar moiety at a central portion of a structure, the compound represented by Formula (3) has good compatibility with the compound represented by Formula (6) and the compound represented by Formula (7), and is easily and uniformly distributed in the surface layer. In addition, since the compound represented by Formula (6) and the compound represented by Formula (7) have a plurality of polymerizable functional groups, the compound represented by Formula (6) and the compound represented by Formula (7) are easily reacted to another polymerizable compound, and thus the surface layer becomes dense. From the fact described above, it is considered that the surface layer becomes easily and uniformly dense, and the environmental dependence of the electrical characteristics of the electrophotographic photosensitive member is reduced.

(6)

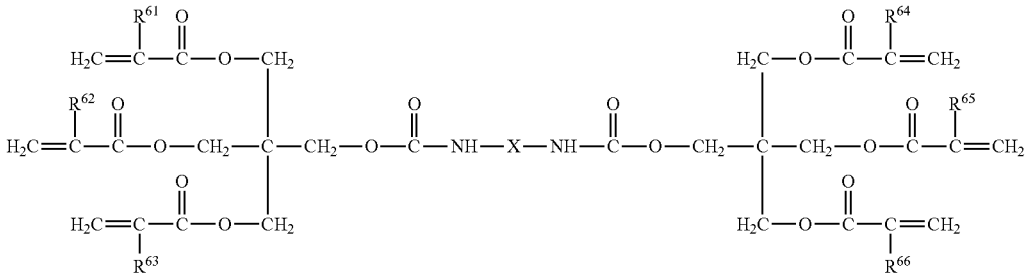

In Formula (6), $R^{61}$ to $R^{66}$ each independently represent a hydrogen atom or a methyl group. X represents a substituted or unsubstituted alkylene group, a substituted or unsubstituted cycloalkylene group, or a substituted or unsubstituted phenylene group. Substituents which may be included in the alkylene group, the cycloalkylene group, and the phenylene group are each independently an alkyl group having 1 or more and 3 or less carbon atoms.

(7)

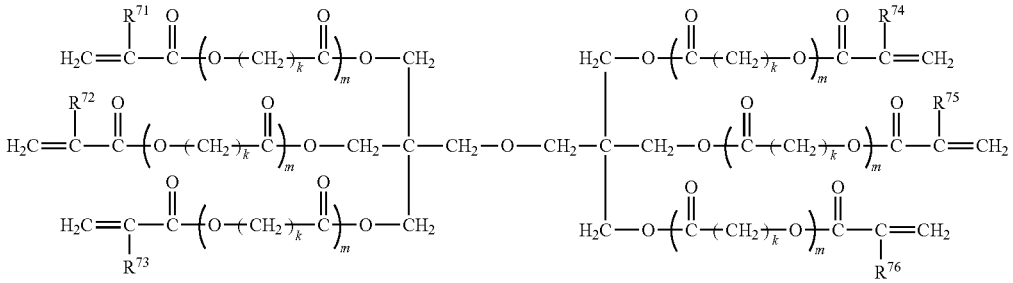

In Formula (7), $R^{71}$ to $R^{76}$ each independently represent a hydrogen atom or a methyl group. k represents an integer of 1 or more and 9 or less, and m represents an integer of 0 or more and 3 or less.

Hereinafter, specific examples of the compound represented by Formula (6) and the compound represented by Formula (7) are described, but the present invention is not limited thereto.

Specific Examples of Compound Represented by Formula (6)

(6-1)

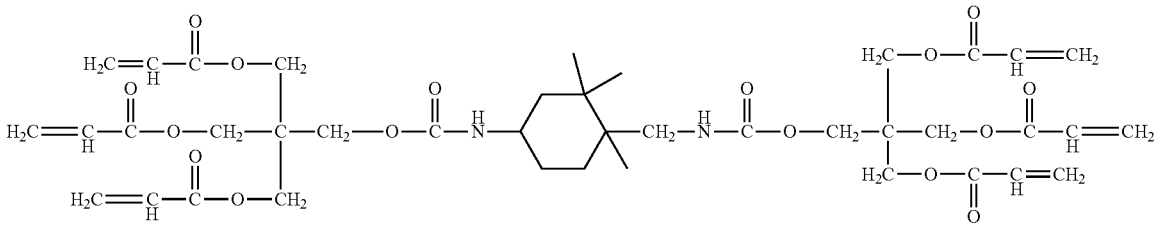

(6-2)

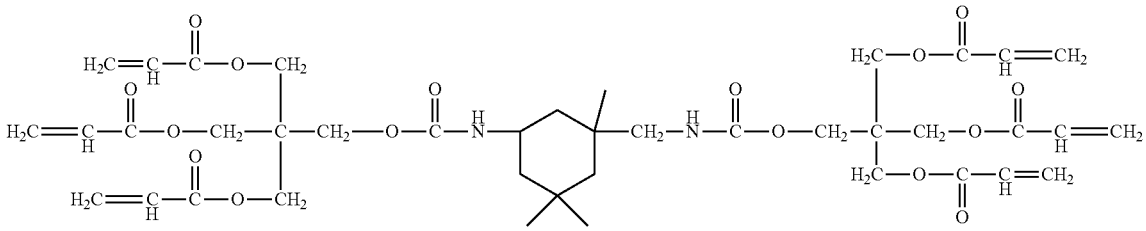

-continued
(6-3)
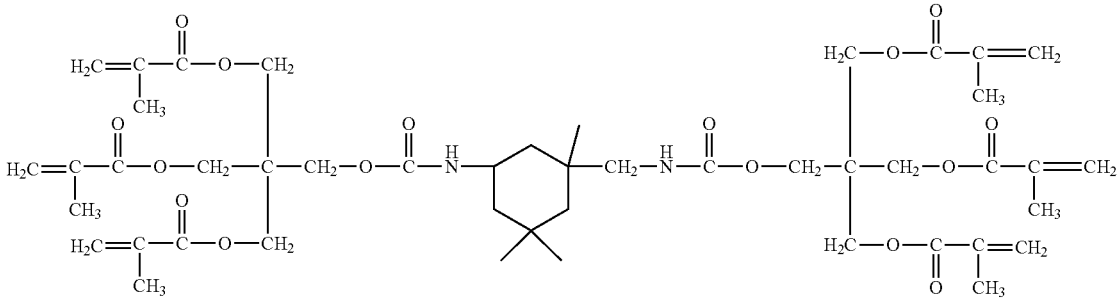
(6-4)
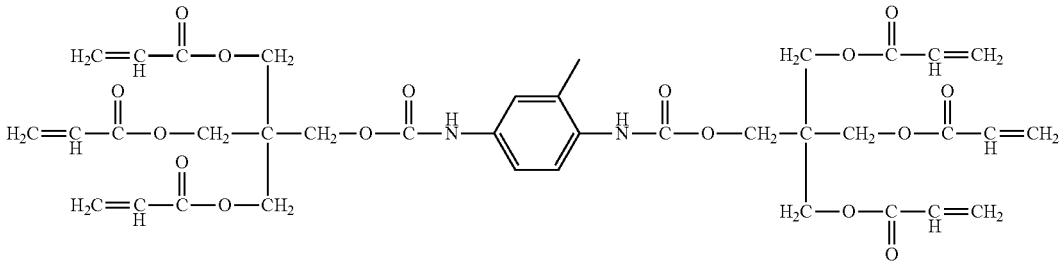
(6-5)
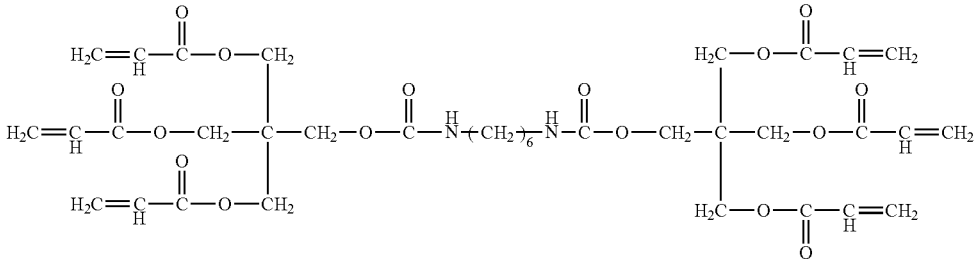
Specific Examples of Compound Represented by Formula (7)
(7-1)
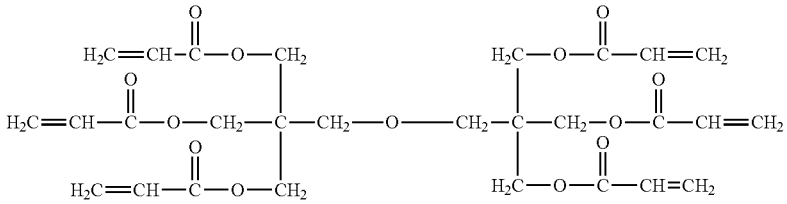
(7-2)
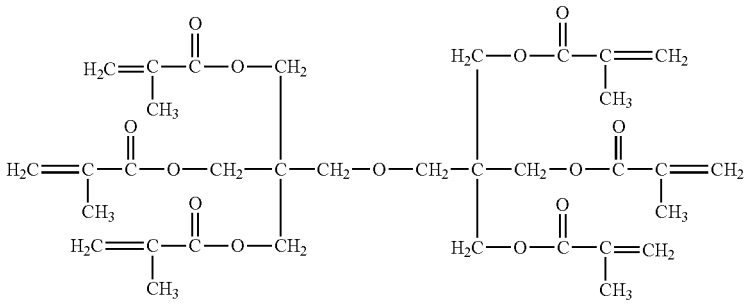

-continued (7-3)

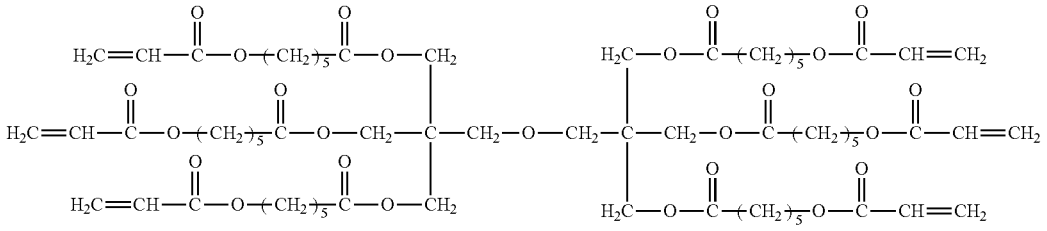

(7-4)

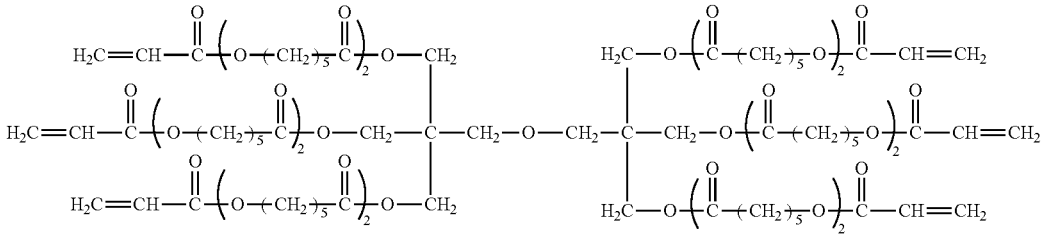

(7-5)

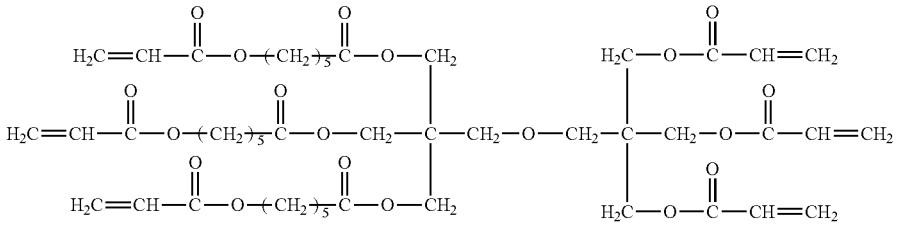

In the composition, contents of the compound represented by Formula (6) and the compound represented by Formula (7) are preferably 5.0 mass % or more and 40.0 mass % or less with respect to the total amount of the compounds in the surface layer.

Next, a configuration of the electrophotographic photosensitive member according to an aspect of the present invention is described.

Electrophotographic Photosensitive Member

The electrophotographic photosensitive member according to an aspect of the present invention includes a support and a surface layer.

FIG. 1 is a view illustrating an example of a layer configuration of the electrophotographic photosensitive member.

In FIG. 1, the electrophotographic photosensitive member includes a support 111, an undercoat layer 112, a charge generating layer 113, a charge transporting layer 114, and a protection layer 115 as the surface layer.

As described above, the surface layer of the electrophotographic photosensitive member contains the copolymer of the composition containing the hole transporting compound represented by Formula (1) and the compound represented by Formula (3).

An example of a method of producing an electrophotographic photosensitive member can include a method in which coating liquids for layers to be described later are prepared and applied on the layers in a desired order, and the coating layers are dried. In this case, examples of a method of applying a coating liquid can include dip coating, spray coating, ink jet coating, roll coating, die coating, blade coating, curtain coating, wire bar coating, and ring coating. Among them, dip coating is preferable from the viewpoint of efficiency and productivity.

Hereinafter, the support and the respective layers are described.

Support

In the present invention, the electrophotographic photosensitive member includes the support. In the present invention, the support is preferably an electroconductive support having electroconductivity. In addition, examples of a shape of the support can include a cylindrical shape, a belt shape, and a sheet shape. Among them, a cylindrical support is preferable. In addition, a surface of the support may be subjected to an electrochemical treatment such as anodization, a blast treatment, or a cutting treatment.

As a material for the support, a metal, a resin, or glass is preferable.

Examples of the metal can include aluminum, iron, nickel, copper, gold, and stainless steel, or alloys thereof. Among them, an aluminum support obtained by using aluminum is preferable.

In addition, electroconductivity may be imparted to the resin or glass through a treatment such as mixing or coating the resin or glass with an electroconductive material.

Electroconductive Layer

In the present invention, an electroconductive layer may be provided on the support. By providing the electroconductive layer, scratches or unevenness of the surface of the support can be concealed, or reflection of light on the surface of the support can be controlled.

The electroconductive layer preferably contains an electroconductive particle and a resin.

Examples of a material for the electroconductive particle can include a metal oxide, a metal, and carbon black. Examples of the metal oxide can include zinc oxide, aluminum oxide, indium oxide, silicon oxide, zirconium oxide, tin oxide, titanium oxide, magnesium oxide, antimony oxide, and bismuth oxide. Examples of the metal can include aluminum, nickel, iron, nichrome, copper, zinc, and silver.

Among them, the metal oxide is preferably used for the electroconductive particle. In particular, titanium oxide, tin oxide, or zinc oxide is more preferably used for the electroconductive particle.

In a case where the metal oxide is used for the electroconductive particle, a surface of the metal oxide may be treated with a silane coupling agent or the like, or the metal oxide may be doped with an element such as phosphorus or aluminum, or an oxide thereof.

In addition, the electroconductive particle may have a laminate structure having a core particle and a covering layer that covers the particle. Examples of a material of the core particle can include titanium oxide, barium sulfate, and zinc oxide. Examples of a material for the covering layer can include a metal oxide such as tin oxide.

In addition, in a case where the metal oxide is used for the electroconductive particle, a volume average particle diameter thereof is preferably 1 nm or more and 500 nm or less, and more preferably 3 nm or more and 400 nm or less.

Examples of the resin can include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the electroconductive layer may further contain a masking agent such as silicone oil, a resin particle, or titanium oxide.

An average thickness of the electroconductive layer is preferably 1 μm or more and 50 μm or less, and particularly preferably 3 μm or more and 40 μm or less.

The electroconductive layer can be formed by preparing a coating liquid for an electroconductive layer that contains the above-mentioned respective materials and a solvent, forming a coating film of the coating liquid, and drying the coating film. Examples of the solvent used in the coating liquid can include an alcohol-based solvent, a sulfoxide-based solvent, a ketone-based solvent, an ether-based solvent, an ester-based solvent, and an aromatic hydrocarbon-based solvent. Examples of a method for dispersing the electroconductive particles in the coating liquid for an electroconductive layer can include methods using a paint shaker, a sand mill, a ball mill, and a liquid collision-type high-speed disperser.

Undercoat Layer

In the present invention, an undercoat layer may be provided on the support or the electroconductive layer. By providing the undercoat layer, an adhesive function between layers can be increased to impart a charge injection-inhibiting function.

The undercoat layer preferably contains a resin. In addition, the undercoat layer may be formed as a cured film by polymerization of a composition containing a monomer having a polymerizable functional group.

Examples of the resin can include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group included in the monomer having a polymerizable functional group can include an isocyanate group, a block isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron transporting substance, a metal oxide, a metal, an electroconductive polymer, and the like, in order to improve electric characteristics. Among them, an electron transporting substance or a metal oxide is preferably used.

Examples of the electron transporting substance can include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron transporting substance having a polymerizable functional group may be used as the electron transporting substance and copolymerized with the above-mentioned monomer having a polymerizable functional group to form an undercoat layer as a cured film.

Examples of the metal oxide can include indium tin oxide, tin oxide, indium oxide, titanium oxide, zinc oxide, aluminum oxide, and silicon dioxide. Examples of the metal can include gold, silver, and aluminum.

In addition, the undercoat layer may further contain an additive.

An average thickness of the undercoat layer is preferably 0.1 μm or more and 50 μm or less, more preferably 0.2 μm or more and 40 μm or less, and particularly preferably 0.3 μm or more and 30 μm or less.

The undercoat layer can be formed by preparing a coating liquid for an undercoat layer containing the above-mentioned respective materials and a solvent, forming a coating film of the coating liquid on the support or the electroconductive layer, and drying and/or curing the coating film. Examples of the solvent used in the coating liquid can include an alcohol-based solvent, a ketone-based solvent, an ether-based solvent, an ester-based solvent, and an aromatic hydrocarbon-based solvent.

Photosensitive Layer

A photosensitive layer of the electrophotographic photosensitive member is mainly classified into (1) a laminate type photosensitive layer and (2) a monolayer type photosensitive layer. (1) The laminate type photosensitive layer has a charge generating layer containing a charge generating substance and a charge transporting layer containing a charge transporting substance. (2) The monolayer type photosensitive layer has a photosensitive layer containing both a charge generating substance and a charge transporting substance.

In the present invention, in a case where the electrophotographic photosensitive member does not include a protection layer, a charge transporting layer in (1) the laminate type photosensitive layer is the surface layer of the present invention, and a photosensitive layer in (2) the monolayer type photosensitive layer is the surface layer of the present invention.

(1) Laminate Type Photosensitive Layer

The laminate type photosensitive layer has a charge generating layer and a charge transporting layer.

(1-1) Charge Generating Layer

The charge generating layer preferably contains a charge generating substance and a resin.

Examples of the charge generating substance can include an azo pigment, a perylene pigment, a polycyclic quinone pigment, an indigo pigment, and a phthalocyanine pigment. Among them, an azo pigment or a phthalocyanine pigment is preferable. Among the phthalocyanine pigments, an oxytitanium phthalocyanine pigment, a chlorogallium phthalocyanine pigment, or a hydroxygallium phthalocyanine pigment is preferable.

A content of the charge generating substance in the charge generating layer is preferably 40 mass % or more and 85 mass % or less, and more preferably 60 mass % or more and 80 mass % or less, with respect to a total mass of the charge generating layer.

Examples of the resin can include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Among them, a polyvinyl butyral resin is more preferable.

In addition, the charge generating layer may further contain an additive such as an antioxidant or an ultraviolet absorber. Specific examples thereof can include a hindered phenol compound, a hindered amine compound, a sulfur compound, a phosphorus compound, and a benzophenone compound.

An average thickness of the charge generating layer is preferably 0.1 μm or more and 1 μm or less, and more preferably 0.15 μm or more and 0.4 μm or less.

The charge generating layer can be formed by preparing a coating liquid for a charge generating layer that contains the above-mentioned respective materials and a solvent, forming a coating film of the coating liquid on the undercoat layer, and drying the coating film. Examples of the solvent used in the coating liquid can include an alcohol-based solvent, a sulfoxide-based solvent, a ketone-based solvent, an ether-based solvent, an ester-based solvent, and an aromatic hydrocarbon-based solvent.

(1-2) Charge Transporting Layer

The charge transporting layer preferably contains a charge transporting substance and a resin.

Examples of the charge transporting substance can include a polycyclic aromatic compound, a heterocyclic compound, a hydrazone compound, a styryl compound, an enamine compound, a benzidine compound, a triarylamine compound, and a resin having a group derived from these substances.

A content of the charge transporting substance in the charge transporting layer is preferably 25 mass % or more and 70 mass % or less, and more preferably 30 mass % or more and 55 mass % or less, with respect to a total mass of the charge transporting layer.

Examples of the resin can include a polyester resin, a polycarbonate resin, an acrylic resin, and a polystyrene resin. Among them, a polycarbonate resin or a polyester resin is preferable. As the polyester resin, a polyarylate resin is particularly preferable.

A content ratio (mass ratio) of the charge transporting substance to the resin is preferably 4:10 to 20:10 and more preferably 5:10 to 12:10.

In addition, the charge transporting layer may also contain additives such as an antioxidant, an ultraviolet absorber, a plasticizer, a leveling agent, a lubricity imparting agent, and an abrasion resistance improver. Specific examples thereof can include a hindered phenol compound, a hindered amine compound, a sulfur compound, a phosphorus compound, a benzophenone compound, a siloxane-modified resin, silicone oil, a fluorine resin particle, a polystyrene resin particle, a polyethylene resin particle, a silica particle, an alumina particle, and a boron nitride particle.

As described above, in the case where the charge transporting layer is the surface layer, the charge transporting layer contains the copolymer of the composition containing the hole transporting compound represented by Formula (1) and the compound represented by Formula (3).

In a case where the electrophotographic photosensitive member includes a protection layer to be described later as the surface layer, that is, the surface layer is provided on and in contact with the charge transporting layer, the charge transporting layer particularly preferably contains a hole transporting compound represented by the following Formula (8). When the charge transporting layer contains the hole transporting compound represented by Formula (8), the environmental dependence of the electrical characteristics of the electrophotographic photosensitive member can be reduced.

(8)

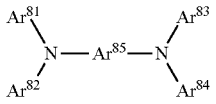

In Formula (8), $Ar^{81}$ to $Ar^{84}$ each independently represent a substituted or unsubstituted phenyl group. $Ar^{85}$ represents a substituted or unsubstituted biphenylene group or a substituted or unsubstituted triphenylene group. Substituents which may be included in the phenyl group, the biphenylene group, and the triphenylene group are each independently an alkyl group having 1 or more and 4 or less carbon atoms.

The reason why the environmental dependence of the electrical characteristics of the electrophotographic photosensitive member is reduced when the charge transporting layer contains the hole transporting compound represented by Formula (8) is presumed by the present inventors as follows.

Since the hole transporting compound represented by Formula (8) has a polymerization inhibition action, cross-linking in the vicinity of an interface between the surface layer and the charge transporting layer in contact with the surface layer is suppressed. Accordingly, copolymerization of the compound represented by Formula (1) and the compound represented by Formula (3) is suppressed at a surface of the surface layer in contact with the charge transporting layer, and mainly proceeds at a surface of the surface layer. That is, it is considered that the denseness at the surface of the surface layer is increased, and the permeation of moisture in the air into the surface layer is thus suppressed.

Hereinafter, specific examples of the compound represented by Formula (8) are described, but the present invention is not limited thereto.

(8-1)

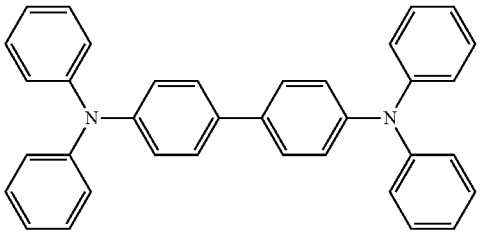

-continued (8-2)

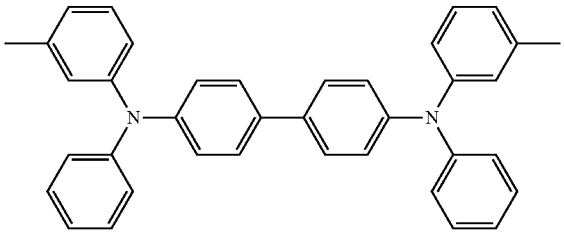

(8-3)

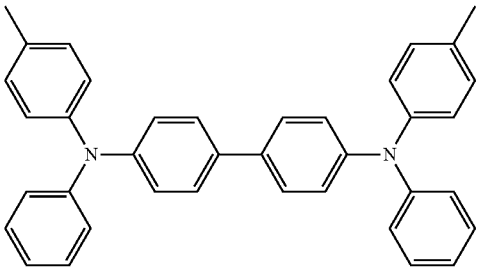

(8-4)

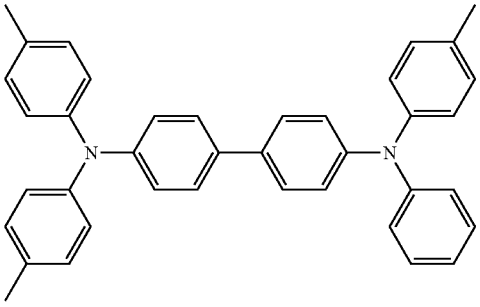

(8-5)

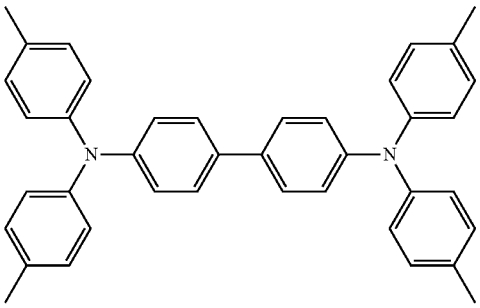

(8-6)

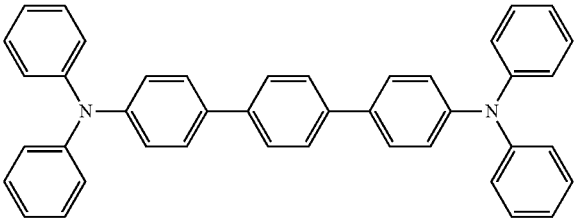

8-7

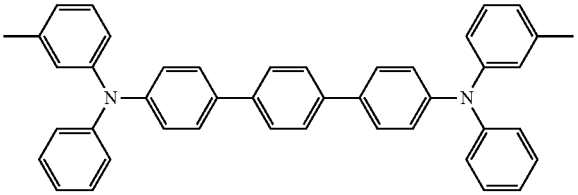

-continued (8-8)

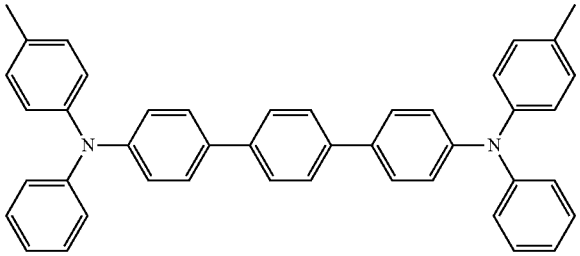

(8-9)

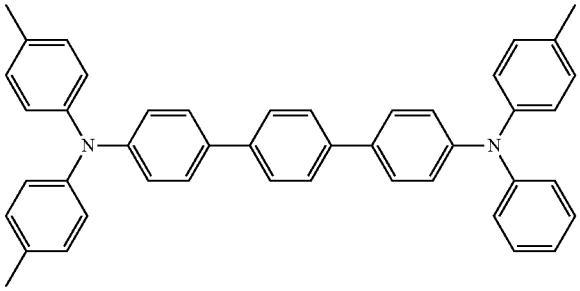

(8-10)

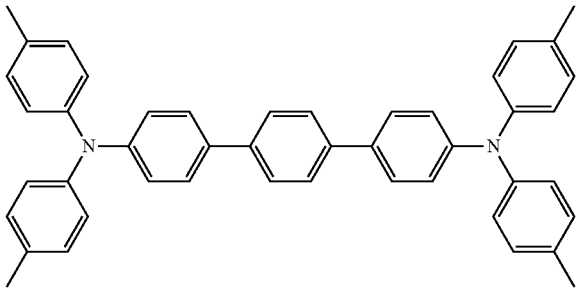

An average thickness of the charge transporting layer is preferably 5 μm or more and 50 μm or less, more preferably 8 μm or more and 40 μm or less, and particularly preferably 10 μm or more and 30 μm or less.

The charge transporting layer can be formed by preparing a coating liquid for a charge transporting layer that contains the above-mentioned respective materials and a solvent, forming a coating film of the coating liquid on the charge generating layer, and drying the coating film. Examples of the solvent used in the coating liquid can include an alcohol-based solvent, a ketone-based solvent, an ether-based solvent, an ester-based solvent, and an aromatic hydrocarbon-based solvent. Among these solvents, an ether-based solvent or an aromatic hydrocarbon-based solvent is preferable.

(2) Monolayer Type Photosensitive Layer

The monolayer type photosensitive layer can be formed by preparing a coating liquid for a photosensitive layer that contains a charge generating substance, a charge transporting substance, a resin, and a solvent, forming a coating film of the coating liquid, and drying the coating film. Examples of materials of the charge generating substance, the charge transporting substance, and the resin are the same as in the "(1) Laminate Type Photosensitive Layer".

As described above, in the case where the monolayer type photosensitive layer is the surface layer, the monolayer type photosensitive layer contains the copolymer of the composition containing the hole transporting compound represented by Formula (1) and the compound represented by Formula (3).

In a case where the electrophotographic photosensitive member includes a protection layer to be described later as the surface layer, that is, the surface layer is provided on and in contact with the monolayer type photosensitive layer, the monolayer type photosensitive layer preferably contains the hole transporting compound represented by Formula (8), for the same reasons as described in the description of the charge transporting layer.

Protection Layer

In the present invention, a protection layer may be provided on the photosensitive layer. By providing the protection layer, durability of the electrophotographic photosensitive member can be improved.

In the case where the electrophotographic photosensitive member includes the protection layer, the protection layer is the surface layer of the present invention, and contains the copolymer of the composition containing the hole transporting compound represented by Formula (1) and the compound represented by Formula (3).

The protection layer may also be formed as a cured film by polymerization of a composition containing a monomer having a polymerizable functional group. Examples of the reaction in this case can include a thermal polymerization reaction, a photopolymerization reaction, and a radiation polymerization reaction. Examples of the polymerizable functional group included in the monomer having a polymerizable functional group can include an acryloyloxy group and a methacryloyloxy group. A material having charge transporting ability may also be used as the monomer having a polymerizable functional group.

The protection layer may also contain additives such as an antioxidant, an ultraviolet absorber, a plasticizer, a leveling agent, a lubricity imparting agent, and an abrasion resistance improver. Specific examples of the additive can include a hindered phenol compound, a hindered amine compound, a sulfur compound, a phosphorus compound, a benzophenone compound, a siloxane-modified resin, silicone oil, a fluorine resin particle, a polystyrene resin particle, a polyethylene resin particle, a silica particle, an alumina particle, and a boron nitride particle.

Furthermore, a charge transporting substance can be added. Examples of the charge transporting substance can include a polycyclic aromatic compound, a heterocyclic compound, a hydrazone compound, a styryl compound, an enamine compound, a benzidine compound, a triarylamine compound, and a resin having a group derived from these substances. Among them, a triarylamine compound or a benzidine compound is preferable.

An average thickness of the protection layer is preferably 0.5 μm or more and 10 μm or less, and more preferably 1 μm or more and 7 μm or less.

The protection layer can be formed by preparing a coating liquid for a protection layer that contains the above-mentioned respective materials and a solvent, forming a coating film of the coating liquid on the photosensitive layer, and drying and/or curing the coating film. Examples of the solvent used in the coating liquid can include an alcohol-based solvent, a ketone-based solvent, an ether-based solvent, a sulfoxide-based solvent, an ester-based solvent, a halogenated aliphatic hydrocarbon-based solvent, and an aromatic hydrocarbon-based solvent. An alcohol-based solvent is preferable, from the viewpoint that the photosensitive layer of the lower layer is not dissolved.

As a method of curing a coating film of a coating liquid for a protection layer, a curing method using heat, ultraviolet rays, and/or electron beams can be used. In order to increase a strength of the protection layer of the electrophotographic photosensitive member and to improve the durability of the electrophotographic photosensitive member, it is preferable that the coating film is cured by using ultraviolet rays or electron beams.

In a case where the coating film is irradiated with electron beams, as an accelerator, a scanning type accelerator, an electrocurtain type accelerator, a broad beam type accelerator, a pulse type accelerator, or a laminar type accelerator can be used. An acceleration voltage of the electron beams is preferably 120 kV or less, from the viewpoint that degradation of the material characteristics due to the electron beams can be suppressed without any loss of polymerization efficiency. In addition, a dose of the electron beams absorbed in the surface of the coating film of the coating liquid for a protection layer is preferably 1 kGy or more and 50 kGy or less, and more preferably 5 kGy or more and 10 kGy or less.

In addition, in a case where the composition is cured (polymerized) by using the electron beams, it is preferable that the composition is irradiated with the electron beams in an inert gas atmosphere, and then the composition is heated in an inert gas atmosphere, from the viewpoint of suppressing a polymerization inhibition action by oxygen. Examples of the inert gas can include nitrogen, argon, and helium.

In addition, it is preferable that the composition is irradiated with ultraviolet rays or electron beams, and then the electrophotographic photosensitive member is heated at 100° C. or higher and 140° C. or lower. By doing so, it is possible to obtain a protection layer having higher durability and implementing suppression of image defects.

A surface of the protection layer may be subjected to a surface processing by using a polishing sheet, a shape transfer type member, a glass bead, or a zirconia bead. In addition, unevenness may also be formed on the surface by using a constituent material for the coating liquid. In order to further stabilize a behavior of a cleaning unit (cleaning blade) which is brought into contact with the electrophotographic photosensitive member, it is more preferable that a concave portion or a convex portion is provided on the protection layer of the electrophotographic photosensitive member.

The concave portion or the convex portion may be formed in the entire region of the surface of the electrophotographic photosensitive member, or may also be formed on a part of the surface of the electrophotographic photosensitive member. In a case where the concave portion or the convex portion is formed on a part of the surface of the electrophotographic photosensitive member, it is preferable that the concave portion or the convex portion is formed on the entire region of at least a contact region with the cleaning unit (cleaning blade).

In the case where the concave portion or the convex portion is formed, the concave portion or the convex portion can be formed on the surface of the electrophotographic photosensitive member, by bringing a mold having a convex portion corresponding to the concave portion or a concave portion corresponding to the convex portion into pressure contact with the surface of the electrophotographic photosensitive member, and performing a shape transfer.

Process Cartridge and Electrophotographic Apparatus

A process cartridge according to another aspect of the present invention integrally supports the electrophotographic photosensitive member described above and at least one unit selected from the group consisting of a charging unit, a developing unit, a transfer unit, and a cleaning unit, and is detachably attachable to a main body of an electrophotographic apparatus.

In addition, an electrophotographic apparatus according to still another aspect of the present invention includes the electrophotographic photosensitive member described above, a charging unit, an exposing unit, a developing unit, and a transfer unit.

Figure 2:
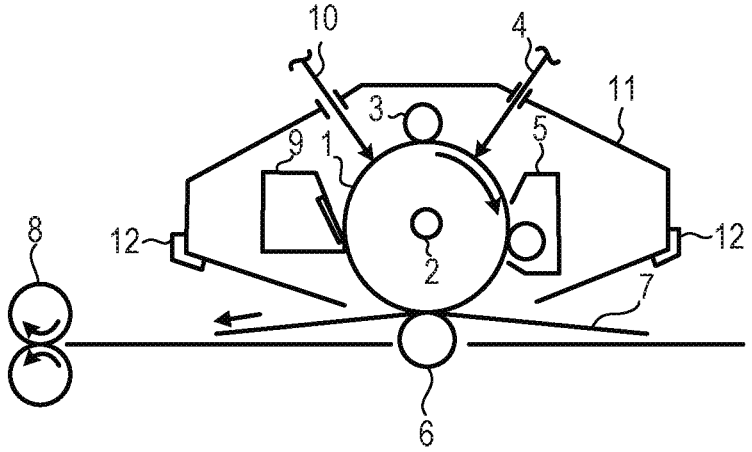
FIG. 2 is a view illustrating an example of a schematic configuration of an electrophotographic apparatus including a process cartridge having an electrophotographic photosensitive member according to an aspect of the present invention.

FIG. 2 illustrates an example of a schematic configuration of an electrophotographic apparatus including a process cartridge having an electrophotographic photosensitive member.

Reference numeral 1 represents a cylindrical electrophotographic photosensitive member, and is rotatably driven about a shaft 2 in the arrow direction at a predetermined peripheral velocity. A surface of the electrophotographic photosensitive member 1 is charged to have a predetermined positive or negative potential by a charging unit 3. Although a roller charging system using a roller type charging member is illustrated in FIG. 2, a charging system such as a corona charging system, a proximity charging system, or an injection charging system may also be adopted. The surface of the charged electrophotographic photosensitive member 1 is irradiated with exposure light 4 emitted from an exposing unit (not illustrated), and an electrostatic latent image corresponding to target image information is formed thereon. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transfer unit 6. The transfer material 7 onto which the toner image is transferred is conveyed to a fixing unit 8, is subjected to a treatment for fixing the toner image, and is printed out to the outside of the electrophotographic apparatus. The electrophotographic apparatus may also include a cleaning unit 9 for removing a deposit, such as the toner remaining on the surface of the electrophotographic photosensitive member 1 after the transfer. In addition, a so-called cleaner-less system configured to remove the deposit with the developing unit 5 or the like without separate provision of the cleaning unit 9 may be used. The electrophotographic apparatus may also include an electricity-removing mechanism configured to subject the surface of the electrophotographic photosensitive member 1 to an electricity-removing treatment with pre-exposure light 10 from a pre-exposing unit (not illustrated). In addition, a guiding unit 12, such as a rail, may be provided for detachably attaching a process cartridge 11 according to another aspect of the present invention to the main body of the electrophotographic apparatus.

The electrophotographic photosensitive member according to an aspect of the present invention can be used in, for example, a laser beam printer, an LED printer, a copying machine, a facsimile, and a composite machine thereof.

EXAMPLES

Hereinafter, the present invention is described in more detail with reference to Examples and Comparative Examples. The present invention is not limited by the following Examples without departing from the gist of the present invention. Further, in the description of the following Examples, unless otherwise specified, the term "part" is on a mass basis.

Example 1

An aluminum cylinder having a diameter of 30 mm, a length of 357.5 mm, and a thickness of 1 mm was prepared as a support (electroconductive support).

Next, 100 parts of a zinc oxide particle (specific surface area: 19 $m^2/g$, powder resistivity: $4.7\times10^6$ Ω·cm) as a metal oxide, and 500 parts of toluene were stirred and mixed. 0.8 parts of a silane coupling agent (compound name: N-2-(aminoethyl)-3-aminopropylmethyldimethoxysilane, trade name: KBM602, manufactured by Shin-Etsu Chemical Co., Ltd.) were added thereto, and stirring was performed for 6 hours. Thereafter, toluene was removed by distillation under a reduced pressure, and heat-drying was performed at 130° C. for 6 hours, thereby obtaining a surface treated zinc oxide particle.

Next, the following materials were prepared.

15 parts of butyral resin (trade name: BM-1, manufactured by SEKISUI CHEMICAL CO., LTD.)

15 parts of blocked isocyanate (trade name: Sumidur 3175, manufactured by Sumika Covestro Urethane Co., Ltd.)

These materials were dissolved in a solution obtained by mixing 73.5 parts of methyl ethyl ketone and 73.5 parts of 1-butanol. 80.8 parts of the surface treated zinc oxide particle and 0.81 parts of 2,3,4-trihydroxybenzophenone (manufactured by Tokyo Chemical Industry Co., Ltd.) were added to the resultant solution. The mixture was dispersed with a sand mill apparatus using a glass bead having a diameter of 0.8 mm in an atmosphere at 23±3° C. for 3 hours. After the dispersion, the following materials were added and stirred to prepare a coating liquid for an undercoat layer.

0.01 parts of silicone oil (trade name: SH28PA, manufactured by Dow Corning Toray Co., Ltd.)

5.6 parts of crosslinked polymethyl methacrylate (PMMA) particle (trade name: TECHPOLYMER SSX-103, manufactured by SEKISUI PLASTICS CO., LTD., average primary particle diameter: 3.0 μm)

The coating liquid for an undercoat layer was applied onto the support by dip coating to form a coating film, and the obtained coating film was dried at 160° C. for 30 minutes, thereby forming an undercoat layer having a thickness of 18 μm.

Next, 10 parts of hydroxygallium phthalocyanine in a crystalline form and 5 parts of a polyvinyl butyral resin (trade name: S-LEC BX-1, manufactured by SEKISUI CHEMICAL CO., LTD.) having peaks at positions of 7.5° and 28.4° in a chart obtained by CuKα characteristic X-ray diffraction were prepared. 200 parts of cyclohexanone were added thereto and dispersed with a sand mill apparatus using a glass bead having a diameter of 0.9 mm for 6 hours. 150 parts of cyclohexanone and 350 parts of ethyl acetate were further added thereto and diluted, thereby obtaining a coating liquid for a charge generating layer. The obtained coating liquid was applied onto the undercoat layer by dip coating to form a coating film, and then the coating film was dried at 95° C. for 10 minutes, thereby forming a charge generating layer having a thickness of 0.20 μm.

Next, the following materials were prepared.

45 parts of compound represented by Formula (8-8)

45 parts of compound represented by Formula (8-10)

10 parts of compound represented by the following Formula (A)

100 parts of polycarbonate resin (trade name: Iupilon Z400, manufactured by Mitsubishi Gas Chemical Co., Ltd., bisphenol Z type polycarbonate)

0.02 parts of polycarbonate represented by the following Formula (B) (viscosity average molecular weight Mv: 20,000)

These materials were dissolved in a solution obtained by mixing 600 parts of mixed xylene and 200 parts of dimethoxymethane, thereby preparing a coating liquid for a charge transporting layer. The coating liquid for a charge transporting layer was applied onto the charge generating layer by dip coating to form a coating film, and the obtained coating film was dried at 100° C. for 30 minutes, thereby forming a charge transporting layer having a thickness of 18 μm.

(A)

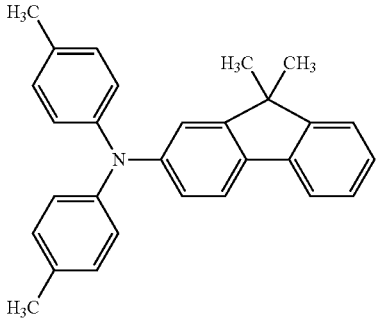

(B)

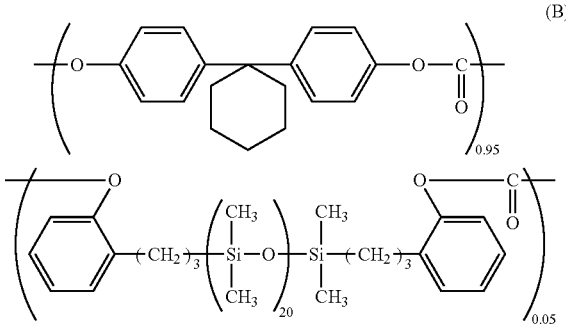

In Formula (B), each of 0.95 and 0.05 is a molar ratio (copolymerization ratio) of two structural units.

Thereafter, the following materials were prepared.

10.0 parts of hole transporting compound represented by Formula (1-19)

4.5 parts of compound represented by Formula (3-1)

5.5 parts of compound represented by Formula (6-1)

0.20 parts of compound represented by Formula (4-21)

0.5 parts of photopolymerization initiator (1-hydroxycyclohexyl phenyl ketone)

80 parts of tetrahydrofuran

These materials were mixed to prepare a coating liquid for a protection layer.

Next, the coating liquid for a protection layer was applied onto the charge transporting layer by dip coating to form a coating film, and the obtained coating film was dried at 60° C. for 5 minutes. After the drying, the coating film was irradiated with ultraviolet rays at an irradiation intensity of 700 mW/cm$^2$ for 120 seconds with a metal halide lamp having an output of 160 W/cm. Thereafter, the coating film was subjected to a heat treatment at 130° C. for 30 minutes, thereby forming a protection layer having a thickness of 5.0 μm.

By doing so, an electrophotographic photosensitive member including the undercoat layer, the charge generating layer, the charge transporting layer, and the protection layer that are formed on the support in this order was produced.

Examples 2 to 5

In the preparation of the coating liquid for a protection layer of Example 1, the types and amounts of the compound represented by Formula (1), the compound represented by Formula (3), the compound represented by Formula (4), and the compound represented by Formula (6) were changed as shown in Table 1. An electrophotographic photosensitive member was produced in the same manner as that of Example 1 except for this.

Example 6

In the preparation of the coating liquid for a charge transporting layer of Example 1, the amount of the compound represented by Formula (A) was changed from 10 parts to 60 parts. In addition, 30 parts of a compound represented by Formula (8-2) was used instead of the compound represented by Formula (8-8) and the compound represented by Formula (8-10). Further, 10 parts of a compound represented by the following Formula (C) was used.

Further, in the preparation of the coating liquid for a protection layer of Example 1, the types and amounts of the compound represented by Formula (1), the compound represented by Formula (3), and the compound represented by Formula (4) were changed as shown in Table 1. In addition, 5.5 parts of a compound represented by Formula (7-1) was used instead of the compound represented by Formula (6-1). An electrophotographic photosensitive member was produced in the same manner as that of Example 1 except for this.

(C)

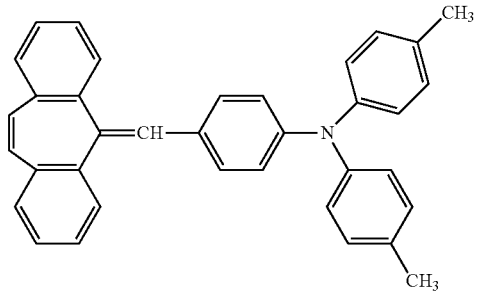

Example 7

In the preparation of the coating liquid for a protection layer of Example 6, a compound represented by Formula (1-1) was used instead of the compound represented by Formula (1-19), and a compound represented by Formula (4-1) was used instead of the compound represented by Formula (4-21). An electrophotographic photosensitive member was produced in the same manner as that of Example 6 except for this.

Example 8

An undercoat layer, a charge generating layer, and a charge transporting layer were formed on the support in the same manner as that of Example 1.

Thereafter, 10.0 parts of a hole transporting compound represented by Formula (1-21), 4.5 parts of the compound represented by Formula (3-1), 0.20 parts of a compound represented by Formula (4-22), and 80 parts of n-propanol were mixed with each other, thereby preparing a coating liquid for a protection layer.

Next, the coating liquid for a protection layer was applied onto the charge transporting layer by dip coating to form a coating film, and the obtained coating film was dried at 40° C. for 5 minutes. After the drying, the coating film was irradiated with electron beams for 1.6 seconds under conditions of an acceleration voltage of 70 kV and an absorbed dose of 15 kGy in a nitrogen atmosphere. Thereafter, the coating film was subjected to a heat treatment for 15 seconds under a condition in which a temperature of the coating film becomes 135° C. in a nitrogen atmosphere. An oxygen concentration from the electron beams irradiation to the heat treatment for 15 seconds was 15 ppm. Next, in the atmosphere, the coating film was subjected to a heat treatment for 30 minutes under a condition in which the temperature of the coating film becomes 105° C., thereby forming a protection layer having a thickness of 5.0 μm.

By doing so, an electrophotographic photosensitive member including the undercoat layer, the charge generating layer, the charge transporting layer, and the protection layer that are formed on the support in this order was produced.

Example 9

In the preparation of the coating liquid for a protection layer of Example 7, a compound represented by the following Formula (D) was used instead of the compound represented by Formula (7-1). An electrophotographic photosensitive member was produced in the same manner as that of Example 7 except for this.

(D)

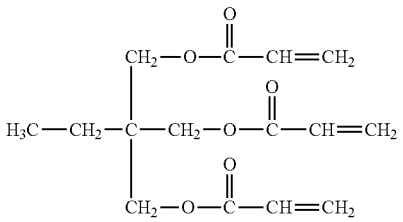

Example 10

In the preparation of the coating liquid for a protection layer of Example 1, the compound represented by Formula (4) was not used. An electrophotographic photosensitive member was produced in the same manner as that of Example 1 except for this.

Example 11

In the preparation of the coating liquid for a protection layer of Example 6, the types and amounts of the compound represented by Formula (1) and the compound represented by Formula (3) were changed as shown in Table 1. In addition, the compound represented by Formula (6-1) was used instead of the compound represented by Formula (7-1). An electrophotographic photosensitive member was produced in the same manner as that of Example 6 except for this.

Examples 12 and 13

In the preparation of the coating liquid for a charge transporting layer of Example 1, 60 parts of the compound represented by Formula (A) and 40 parts of the compound represented by Formula (C) were used without using the compounds represented by Formulas (8-8) and (8-10). Further, in the preparation of the coating liquid for a protection layer of Example 1, the types and amounts of the compound represented by Formula (1), the compound represented by Formula (3), and the compound represented by Formula (4) were changed as shown in Table 1. An electrophotographic photosensitive member was produced in the same manner as that of Example 1 except for this.

Example 14

In the preparation of the coating liquid for a protection layer of Example 6, the type and amount of the compound represented by Formula (1) were changed as shown in Table 1, and the compound represented by Formula (4) and the compound represented by Formula (7) were not used. An electrophotographic photosensitive member was produced in the same manner as that of Example 6 except for this.

Example 15

In the preparation of the coating liquid for a charge transporting layer of Example 1, 60 parts of the compound represented by Formula (A) and 40 parts of the compound represented by Formula (C) were used without using the compounds represented by Formulas (8-8) and (8-10).

Furthermore, in the preparation of the coating liquid for a protection layer of Example 1, the type and amount of the compound represented by Formula (3) were changed as shown in Table 1, and the compound represented by Formula (6) was not used.

An electrophotographic photosensitive member was produced in the same manner as that of Example 1 except for this.

Examples 16 to 20

In Example 15, the type and amount of the compound represented by Formula (3) were changed as shown in Table 1, and the compound represented by Formula (4) was not used. An electrophotographic photosensitive member was produced in the same manner as that of Example 15 except for this.

Comparative Example 1

In the preparation of the coating liquid for a protection layer of Example 16, the compound represented by Formula (3) was not used. An electrophotographic photosensitive member was produced in the same manner as that of Example 16 except for this.

Comparative Example 2

In the preparation of the coating liquid for a protection layer of Comparative Example 1, 4.5 parts of a compound represented by the following Formula (E) was further used. An electrophotographic photosensitive member was produced in the same manner as that of Comparative Example 1 except for this.

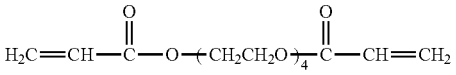

(E)

Comparative Example 3

In the preparation of the coating liquid for a protection layer of Comparative Example 1, 4.5 parts of a compound represented by the following Formula (F) was further used. An electrophotographic photosensitive member was produced in the same manner as that of Comparative Example 1 except for this.

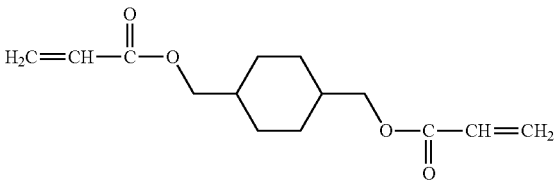

(F)

Comparative Example 4

In the preparation of the coating liquid for a protection layer of Comparative Example 1, 5.5 parts of the compound represented by Formula (D) was further used. An electrophotographic photosensitive member was produced in the same manner as that of Comparative Example 1 except for this.

Comparative Example 5

In the preparation of the coating liquid for a protection layer of Comparative Example 1, 0.20 parts of the compound represented by Formula (4-21) and 5.5 parts of the compound represented by Formula (6-1) were further used. An electrophotographic photosensitive member was produced in the same manner as that of Comparative Example 1 except for this.

TABLE 1

| | Formula (1) | | Formula (3) | | Ratio | Formula (4) | | Formulas (6) and (7) | | 1-Hydroxycyclohexyl phenyl ketone | Others | |
|---|---|---|---|---|---|---|---|---|---|---|---|---|
| | Compound | Part | Compound | Part | (3)/(1) | Compound | Part | Compound | Part | Part | Compound | Part |
| Example 1 | (1-19) | 10.0 | (3-1) | 4.5 | 0.45 | (4-21) | 0.20 | (6-1) | 5.5 | 0.5 | — | — |
| Example 2 | (1-19) | 10.0 | (3-1) | 2.5 | 0.25 | (4-21) | 0.20 | (6-1) | 5.5 | 0.5 | — | — |
| Example 3 | (1-19) | 10.0 | (3-1) | 7.0 | 0.70 | (4-21) | 0.30 | (6-1) | 3.0 | 0.5 | — | — |
| Example 4 | (1-19) | 10.0 | (3-3) | 4.5 | 0.45 | (4-21) | 0.20 | (6-1) | 2.8 | 0.5 | — | — |
| Example 5 | (1-21) | 10.0 | (3-1) | 4.5 | 0.45 | (4-22) | 0.10 | (6-1) | 5.5 | 0.5 | — | — |
| Example 6 | (1-19) | 10.0 | (3-1) | 4.5 | 0.45 | (4-21) | 0.20 | (7-1) | 5.5 | 0.5 | — | — |
| Example 7 | (1-1) | 10.0 | (3-1) | 4.5 | 0.45 | (4-1) | 0.20 | (7-1) | 5.5 | 0.5 | — | — |
| Example 8 | (1-21) | 10.0 | (3-1) | 4.5 | 0.45 | (4-22) | 0.20 | — | — | — | — | — |
| Example 9 | (1-1) | 10.0 | (3-1) | 4.5 | 0.45 | (4-1) | 0.20 | — | — | 0.5 | Formula (D) | 5.5 |
| Example 10 | (1-19) | 10.0 | (3-1) | 4.5 | 0.45 | — | — | (6-1) | 5.5 | 0.5 | — | — |
| Example 11 | (1-1) | 10.0 | (3-4) | 4.5 | 0.45 | (4-1) | 0.20 | (6-1) | 5.5 | 0.5 | — | — |
| Example 12 | (1-19) | 10.0 | (3-4) | 4.5 | 0.45 | (4-21) | 0.20 | (6-1) | 5.5 | 0.5 | — | — |
| Example 13 | (1-24) | 10.0 | (3-6) | 4.5 | 0.45 | (4-24) | 0.20 | (6-1) | 5.5 | 0.5 | — | — |
| Example 14 | (1-21) | 10.0 | (3-1) | 4.5 | 0.45 | — | — | — | — | 0.5 | — | — |
| Example 15 | (1-19) | 10.0 | (3-6) | 4.5 | 0.45 | (4-21) | 0.20 | — | — | 0.5 | — | — |
| Example 16 | (1-19) | 10.0 | (3-4) | 4.5 | 0.45 | — | — | — | — | 0.5 | — | — |
| Example 17 | (1-19) | 10.0 | (3-4) | 1.0 | 0.10 | — | — | — | — | 0.5 | — | — |
| Example 18 | (1-19) | 10.0 | (3-4) | 10.0 | 1.00 | — | — | — | — | 0.5 | — | — |
| Example 19 | (1-19) | 10.0 | (3-4) | 0.5 | 0.05 | — | — | — | — | 0.5 | — | — |
| Example 20 | (1-19) | 10.0 | (3-4) | 12.0 | 1.20 | — | — | — | — | 0.5 | — | — |
| Comparative Example 1 | (1-19) | 10.0 | — | — | 0 | — | — | — | — | 0.5 | — | — |
| Comparative Example 2 | (1-19) | 10.0 | — | — | 0 | — | — | — | — | 0.5 | Formula (E) | 4.5 |
| Comparative Example 3 | (1-19) | 10.0 | — | — | 0 | — | — | — | — | 0.5 | Formula (F) | 4.5 |
| Comparative Example 4 | (1-19) | 10.0 | — | — | 0 | — | — | — | — | 0.5 | Formula (D) | 5.5 |
| Comparative Example 5 | (1-19) | 10.0 | — | — | 0 | (4-21) | 0.20 | (6-1) | 5.5 | 0.5 | — | — |

Evaluation

Electrical characteristics of the electrophotographic photosensitive members produced in Examples 1 to 20 and Comparative Examples 1 to 5 were evaluated as follows.

Evaluation of Electrical Characteristics

Evaluation 1

As an evaluation apparatus, a modified machine of a copying machine (trade name: iR-ADV C5560, manufactured by Canon Inc.) was used. Each of the electrophotographic photosensitive members produced in Examples 1 to 20 and Comparative Examples 1 to 5 was mounted on a drum cartridge for the evaluation apparatus, and the evaluation was carried out as follows.

Evaluation of Electrical Characteristics Under Normal-Temperature and Low-Humidity Environment Under a normal-temperature and low-humidity environment of a temperature of 20° C. and a humidity of 5% RH, a condition of an application voltage and a condition of an exposure light intensity of an exposure light apparatus were set so that an initial dark part potential (Vd) and an initial bright part potential (Vl) of the electrophotographic photosensitive member became −800 [V] and −300 [V], respectively.

A surface potential of the electrophotographic photosensitive member was measured by pulling out a cartridge for development from the evaluation apparatus, and fixing a potential probe (trade name: model 6000B-8, manufactured by Trek, Inc.) thereon, by using a surface potential meter (model 344: manufactured by Trek, Inc.).

Thereafter, images having an image printing ratio of 10% were continuously formed on 50,000 sheets, 100,000 sheets, and 300,000 sheets of A4-size plain paper.

After the images of 50,000 sheets, 100,000 sheets, and 300,000 sheets were printed out, the cartridge for development was replaced with a potential measuring apparatus including the potential probe and the surface potential meter. Thereafter, a bright part potential (Vla) of the surface of the electrophotographic photosensitive member when the set application voltage was applied and light was exposed at the set exposure light intensity was measured. Then, a variation amount |ΔVlaa| (absolute value of ΔVl represented by ΔVl=|Vla|−300) of the bright part potential of the surface of the electrophotographic photosensitive member during an initial stage and after the continuous image formation for each sheet was calculated.

In addition, after the respective images were output, a condition of an application voltage (condition A-1) and a condition of an exposure light intensity of an exposure light apparatus (condition A-2) were set so that the dark part potential (Vd) and the bright part potential (Vl) became −800 [V] and −300 [V], respectively. Values of the set application voltage and the exposure light intensity of the exposure light apparatus were fixed, and solid images of 1,000 sheets were output. Thereafter, under the condition of the application voltage (condition A-1) and the condition of the exposure light intensity of the exposure light apparatus (condition A-2), a bright part potential (Vlb) of the surface of the electrophotographic photosensitive member was measured. Then, a variation amount |ΔVlbb| (absolute value of ΔVl represented by ΔVl=|Vlb|−300) of the bright part potential of the surface of the electrophotographic photosensitive member during an initial stage and after the continuous image formation for each sheet was calculated.

Evaluation 2

Under a high-temperature and high-humidity environment of a temperature of 35° C. and a humidity of 80% RH, a condition of an application voltage and a condition of an exposure light intensity of an exposure light apparatus were set so that an initial dark part potential (Vd) and an initial bright part potential (Vl) of the obtained electrophotographic photosensitive member became −800 [V] and −300 [V], respectively.

The surface potential of the electrophotographic photosensitive member was measured as in the "Evaluation 1".

Thereafter, images having an image printing ratio of 10% were continuously formed on 50,000 sheets, 100,000 sheets, and 300,000 sheets of A4-size plain paper.

After the images of 50,000 sheets, 100,000 sheets, and 300,000 sheets were printed out, the cartridge for development was replaced with a potential measuring apparatus including the potential probe and the surface potential meter. Thereafter, a bright part potential (Vlc) of the surface of the electrophotographic photosensitive member when the set applied voltage was applied and light was exposed at the set exposure light intensity was measured. Then, a variation amount |ΔVlcc| (absolute value of ΔVl represented by ΔVl=|Vlc|−300) of the bright part potential of the surface of the electrophotographic photosensitive member during an initial stage and after the continuous image formation for each sheet was calculated.

In addition, after the respective images were output, a condition of an applied voltage (condition B-1) and a condition of an exposure light intensity of an exposure light apparatus (condition B-2) were set so that the dark part potential (Vd) and the bright part potential (Vl) became −800 [V] and −300 [V], respectively. Values of the set application voltage and the exposure light intensity of the exposure light apparatus were fixed, and solid images of 1,000 sheets were output. Thereafter, under the condition of the application voltage (condition B-1) and the condition of the exposure light intensity of the exposure light apparatus (condition B-2), a bright part potential (Vld) of the surface of the electrophotographic photosensitive member was measured. Then, a variation amount |ΔVldd| (absolute value of ΔVl represented by ΔVl=|Vld|−300) of the bright part potential of the surface of the electrophotographic photosensitive member during an initial stage and after the continuous image formation for each sheet was calculated.

Next, in the evaluation 1 and the evaluation 2, after the respective images of the sheets were output, a rank of each difference (|ΔVlab|) between |ΔVlaa| and |ΔVlbb| was given according to the following criteria.

Rank 4: |ΔVlab| is less than 10 V
Rank 3: |ΔVlab| is less than 15 V
Rank 2: |ΔVlab| is less than 20 V
Rank 1: |ΔVlab| is 20 V or higher In addition, in the evaluation 1 and the evaluation 2, after the respective images of the sheets were output, a rank of each difference (|ΔVlcd|) between |ΔVlcc| and |ΔVldd| was given according to the following criteria.

Rank 4: |ΔVlcd| is less than 5 V
Rank 3: |ΔVlcd| is less than 10 V
Rank 2: |ΔVlcd| is less than 15 V
Rank 1: |ΔVlcd| is 15 V or higher

TABLE 2

| | \|ΔVlab\| | | | \|ΔVlcd\| | | |
|---|---|---|---|---|---|---|
| | 50,000 sheets | 100,000 sheets | 300,000 sheets | 50,000 sheets | 100,000 sheets | 300,000 sheets |
| Example 1 | 4 | 4 | 4 | 4 | 4 | 4 |
| Example 2 | 4 | 4 | 4 | 4 | 4 | 4 |
| Example 3 | 4 | 4 | 4 | 4 | 4 | 4 |
| Example 4 | 4 | 4 | 4 | 4 | 4 | 4 |
| Example 5 | 4 | 4 | 4 | 4 | 4 | 4 |
| Example 6 | 4 | 4 | 4 | 4 | 4 | 4 |

TABLE 2-continued

| | \|ΔVlab\| | | | \|ΔVlcd\| | | |
|---|---|---|---|---|---|---|
| | 50,000 sheets | 100,000 sheets | 300,000 sheets | 50,000 sheets | 100,000 sheets | 300,000 sheets |
| Example 7 | 4 | 4 | 4 | 4 | 4 | 4 |
| Example 8 | 4 | 4 | 3 | 4 | 4 | 4 |
| Example 9 | 4 | 4 | 3 | 4 | 4 | 4 |
| Example 10 | 4 | 4 | 3 | 4 | 4 | 4 |
| Example 11 | 4 | 4 | 3 | 4 | 4 | 3 |
| Example 12 | 4 | 4 | 3 | 4 | 4 | 3 |
| Example 13 | 4 | 3 | 3 | 4 | 4 | 3 |
| Example 14 | 4 | 3 | 3 | 4 | 4 | 3 |
| Example 15 | 4 | 3 | 3 | 4 | 3 | 3 |
| Example 16 | 4 | 3 | 3 | 4 | 3 | 3 |
| Example 17 | 4 | 3 | 3 | 4 | 3 | 3 |
| Example 18 | 4 | 3 | 3 | 4 | 3 | 3 |
| Example 19 | 4 | 3 | 3 | 3 | 3 | 3 |
| Example 20 | 4 | 3 | 3 | 3 | 3 | 3 |
| Comparative Example 1 | 3 | 2 | 2 | 3 | 2 | 2 |
| Comparative Example 2 | 3 | 2 | 2 | 3 | 3 | 2 |
| Comparative Example 3 | 3 | 2 | 2 | 3 | 3 | 2 |
| Comparative Example 4 | 3 | 2 | 2 | 3 | 3 | 2 |
| Comparative Example 5 | 3 | 3 | 2 | 3 | 3 | 3 |

As described above with reference to the embodiments and the examples, the present disclosure can provide an electrophotographic photosensitive member that has high mechanical durability and small variations in electrical characteristics in a temperature and humidity environment, and can thus obtain a stable image. In addition, another aspect of the present invention can provide a process cartridge having the electrophotographic photosensitive member, and an electrophotographic apparatus including the electrophotographic photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-086292, filed Apr. 26, 2019, which is hereby incorporated by reference herein in its entirety.

What is claimed is:

1. An electrophotographic photosensitive member, comprising:

a support and a protection layer as a surface layer of the electrophotographic photosensitive member, the protection layer being a cured film formed by polymerization of monomers contained in a composition, each of the monomers having a polymerizable functional group, the monomers consisting of a hole transporting compound represented by Formula (1-19) and compounds represented by Formulae (3-1), (4-21) and (6-1)

(1-19)

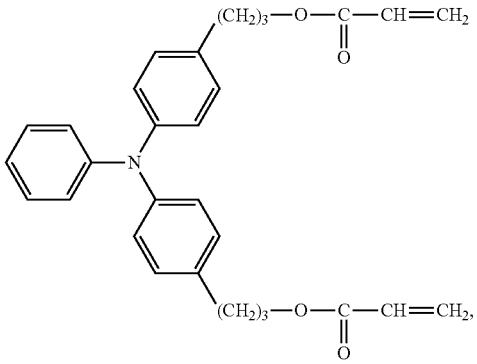

(3-1)

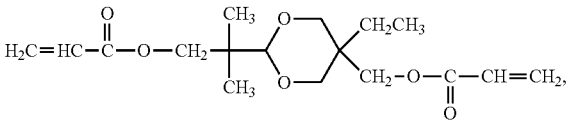

(4-21)

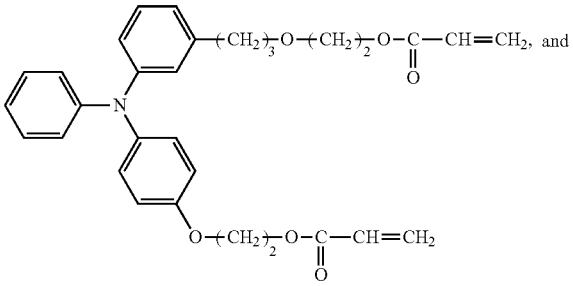

-continued (6-1)

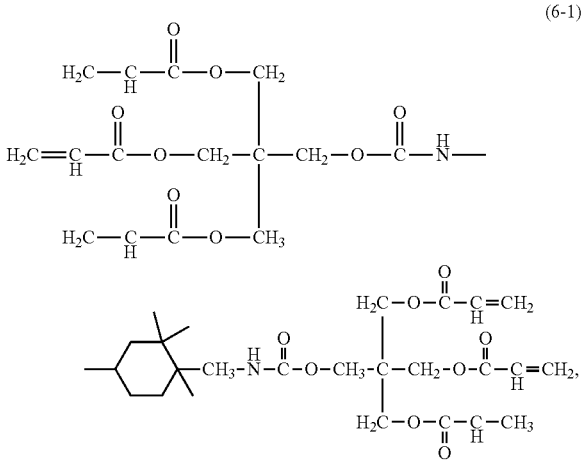

wherein the only monomers in the composition are the compounds according to Formulae (1-19), (3-1), (4-21) and (6-1).

2. The electrophotographic photosensitive member according to claim 1, wherein a content by mass of the compound represented by Formula (3-1) in the composition is 0.1 to 1.0 times greater than that of the hole transporting compound represented by Formula (1-19).

3. The electrophotographic photosensitive member according to claim 1, wherein the surface layer is provided in contact with a charge transporting layer, and (1-19)

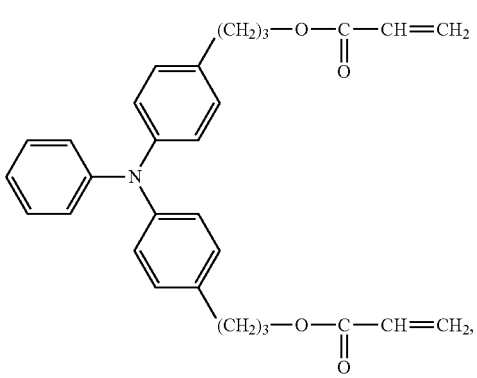

(3-1)

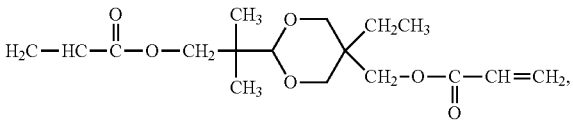

(4-21)

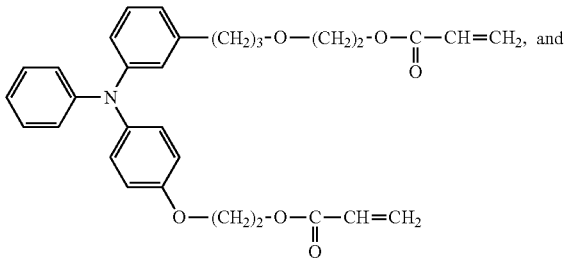

the charge transporting layer contains a hole transporting compound represented by Formula (8)

(8)

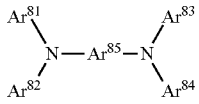

where $Ar^{81}$ to $Ar^{84}$ independently represent an optionally substituted phenyl group, $Ar^{85}$ represents an optionally substituted biphenylene group or an optionally substituted triphenylene group, and substituents that may be included in the phenyl, biphenylene, and triphenylene groups are independently selected from alkyl groups having 1 to 4 carbon atoms.

4. An electrophotographic apparatus, comprising:

an electrophotographic photosensitive member, a charging unit, an exposing unit, a developing unit, and a transfer unit;

the electrophotographic photosensitive member comprising a support and a protection layer as a surface layer of the electrophotographic photosensitive member, the protection layer being a cured film formed by polymerization of monomers contained in a composition, each of the monomers having a polymerizable functional group, the monomers consisting of a hole transporting compound represented by Formula (1-19) and compounds represented by Formulae (3-1), (4-21) and (6-1)

-continued (6-1)

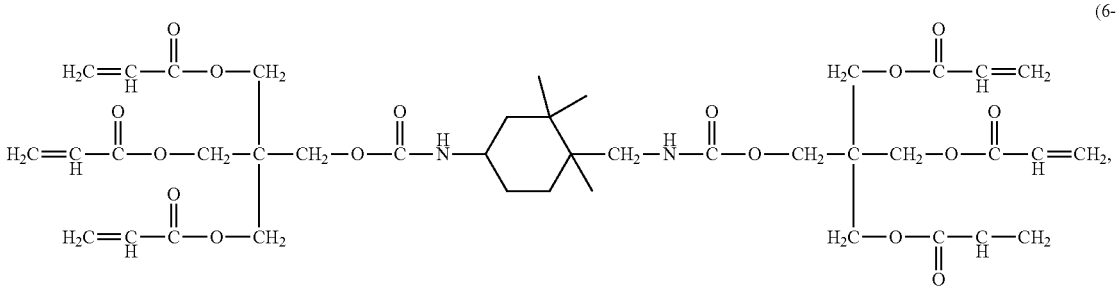

wherein the only monomers in the composition are the compounds according to Formulae (1-19), (3-1), (4-21) and (6-1).

5. A process cartridge integrally supporting an electrophotographic photosensitive member and at least one unit selected from the group consisting of a charging unit, a developing unit, a transfer unit and a cleaning unit, and being detachably attachable to a main body of an electrophotographic apparatus;

the electrophotographic photosensitive member comprising a support and a protection layer as a surface layer of the electrophotographic photosensitive member, the protection layer being a cured film formed by polymerization of monomers contained in a composition, each of the monomers having a polymerizable functional, the monomers consisting of a hole transporting compound represented by Formula (1-19) and compounds represented by Formulae (3-1), (4-21) and (6-1)

(1-19)

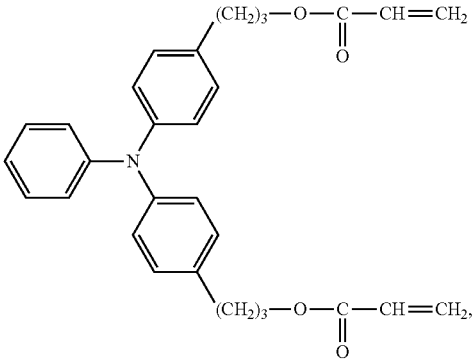

(3-1)

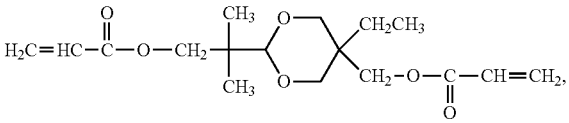

-continued (4-21)

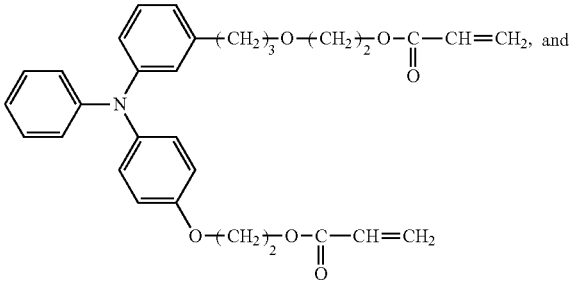

(6-1)

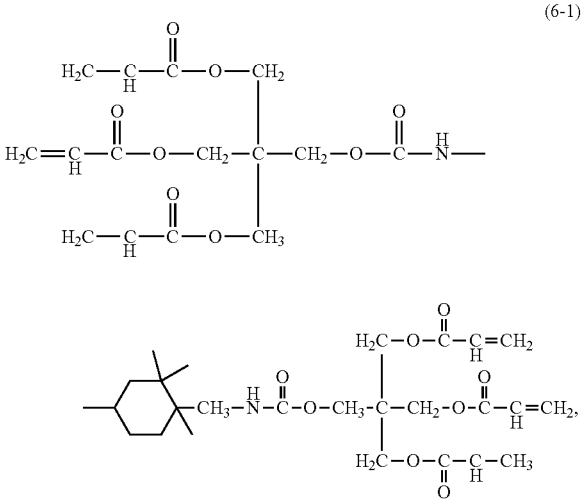

wherein the only monomers in the composition are the compounds according to Formulae (1-19), (3-1), (4-21) and (6-1).

* * * * *